US006574526B1

(12) United States Patent
Gaukler et al.

(10) Patent No.: US 6,574,526 B1
(45) Date of Patent: Jun. 3, 2003

(54) PROCEDURE AND AN APPARATUS FOR THE CONTROL OF A COMPONENT OF A TEXTILE MACHINE POSSESSING A PLURALITY OF SIMILAR WORK-STATIONS BESIDE ONE ANOTHER

(75) Inventors: Jürgen Gaukler, Stuttgart (DE); Mario Maleck, Kipfenberg (DE)

(73) Assignee: Rieter Ingolstadt Spinnereimaschinenbau AG, Ingolstadt (DE)

( * ) Notice: Subject to any disclaimer, the term of this patent is extended or adjusted under 35 U.S.C. 154(b) by 0 days.

(21) Appl. No.: 09/573,708

(22) Filed: May 18, 2000

(30) Foreign Application Priority Data

May 20, 1999 (DE) ..... 199 23 047

(51) Int. Cl.[7] ..... G06F 19/00
(52) U.S. Cl. ..... 700/139
(58) Field of Search ..... 700/139, 130, 700/136, 137, 138, 140, 141, 18; 710/9, 8, 17, 104; 112/155, 470.01, 470.06, 102.5, 475.19; 340/825.23

(56) References Cited

U.S. PATENT DOCUMENTS

| | | | | |
|---|---|---|---|---|
| 4,360,870 A | | 11/1982 | McVey | |
| 5,152,132 A | | 10/1992 | Strobel et al. | |
| 5,222,218 A | | 6/1993 | Smith | |
| 5,519,636 A | | 5/1996 | Stoll et al. | |
| 5,590,045 A | * | 12/1996 | Kaak et al. | 700/139 |
| 5,745,787 A | | 4/1998 | Martschin et al. | |
| 5,838,570 A | | 11/1998 | Barea | |
| 5,862,405 A | | 1/1999 | Fukuda et al. | |
| 5,914,957 A | | 6/1999 | Dean et al. | |
| 6,295,481 B1 | * | 9/2001 | Price | 700/136 |

FOREIGN PATENT DOCUMENTS

| | | |
|---|---|---|
| DE | 3324360 A1 | 1/1984 |
| DE | 3813945 A1 | 10/1988 |
| DE | 4216242 C2 | 11/1993 |
| DE | 4422523 A1 | 1/1996 |
| EP | 0385530 A1 | 9/1990 |
| GB | 2284691 A | 6/1995 |
| WO | WO 9616370 | 5/1996 |
| WO | WO 9914643 | 3/1999 |

OTHER PUBLICATIONS

EPO Search Report, Sep. 11, 2000.

German Search Report, Oct. 6, 1999.

* cited by examiner

*Primary Examiner*—Peter Nerbun
(74) *Attorney, Agent, or Firm*—Dority & Manning

(57) ABSTRACT

A procedure is provided for controlling individual components of a work station in a textile machine. The textile machine includes a plurality of the work stations with each work station having individual control devices. Components of the work stations are connected to a bus system, and the bus system is connected to a central control apparatus. A default value identifying address is set for the components. The central control apparatus recognizes that the components have been installed at the work stations and a recognition phase is initialized wherein the components are interrogated by the central control apparatus. The default address is converted to a component specific address for each of the components and the same type of components have different specific addresses. Operation of the components is controlled through the central control apparatus that communicates with selected components through their respective control device in accordance with their respective component specific address.

21 Claims, 8 Drawing Sheets

PROCEDURE AND AN APPARATUS FOR THE CONTROL OF A COMPONENT OF A TEXTILE MACHINE POSSESSING A PLURALITY OF SIMILAR WORK-STATIONS BESIDE ONE ANOTHER

BACKGROUND

The present invention concerns a procedure for the control of a component of a textile machine having a multiplicity of adjacent work-stations and concerns also an apparatus for the carrying out of this procedure.

In the field of modern textile machines, for the control of the complex operations, it is customary to provide components at each work-station, which are controlled with the aid of individual control devices, which maintain communication with a central control apparatus through a bus system (EP 0 385 530 A1). When such a system is put to use, the problem arises of creating a secure and trouble free communication between the central control apparatus and the individual control devices. This is necessary, in order that each individual control device is specifically regulated, and by means of each individual station, independent of the others, complex procedures can be carried out in coaction with the central control apparatus.

In the thought of the present invention, under the concept of "Component" is to be understood that apparatus, which is controllable and thereby can influence the final state of a product in a varying manner. It is self explanatory, that in accord with the kind of a textile machine, these components can be of different kinds. However, even in textile machines of similar types, the components can be designed in different ways, which is dependent on the special construction of the machine and the differing degree of automization.

SUMMARY OF THE INVENTION

Thus, a purpose of the present invention is to create a simple procedure and an apparatus, with which the components at individual work-stations can be controlled in a straightforward and precise manner. Additional objects and advantages of the invention will be set forth in part in the following description, or may be obvious from the description, or may be learned through practice of the invention.

This purpose will be achieved, in accord with the invention, by the features of the invention wherein each component at the work-stations having an individual control device is marked by a default address and is connected to a bus-system which is connected to a central control apparatus, and for this component a recognition phase, in an optional sequence is initialized, in the course of which, the said default address is converted to a component-specific address. By means of this procedure, each individual control device, in a simple and secure manner will be assigned an individual, component-specific address.

The term "component-specific" is to be understood, in the concept of the present invention, as the special assignment of a certain component to a specific work-station. If this work-station possesses several components, then, each component will receive its own individual component-specific address.

During the installation and the connecting of a component, under certain circumstances, other data must be exchanged than is the case during the normal course of operation. On this account, for such an installation, in the central control apparatus, a special program, that is, a specific programming mode, i.e. exchange mode, is activated.

If, at any point in time, several components are exchanged, then this can be carried out with no effect on the addressing which is to take place later wherein an initialization phase is initialized, in the course of which the component-specific addresses, in combination with the individual control devices connected to the central control apparatus, then revert to the given default address, before the recognition phase in the optional sequence, is initialized for the components which are in communication with the central control apparatus. After the assignment of a default address, all of the components assigned to the central control apparatus are controllingly isolated from the central control apparatus, so that the components can again be connected with the central control apparatus in the specified sequence and the recognition phase initialized, in the course of which the default address of the newly entered components are converted into corresponding component-specific addresses, and simultaneously, in each case, the next sequential component is controllingly in communication with the central control apparatus for the carrying out of its recognition phase. Since the recognition phase is made with the issuance of component-specific addresses, only in connection with the work associated with the exchange, the addressing can be carried in a simple manner and without interruption which normally occurs during installation work.

By the use of a development wherein following the exchange of an individual component, the component-specific address of that removed component is assigned to a replacing component, it is not necessary, upon the exchange of only a single component, to carry out the assignment of component-specific addresses to all the components communicating with the central control apparatus.

Advantageously, the component-specific addresses have been determined in such a manner, i.e., by relative location of the component, that they enable a saving in time in both assembly and initialization.

So that the central control apparatus equipment can be checked, even before the start of the inclusion of a component, as to whether or not, besides the component which is to be installed, other components await installation, it is of advantage to initiate the recognition phase even before the first of the components assigned to a central control apparatus is connected to a bus system.

In order to exclude an erroneous connection of components, an embodiment of the invention provides information as to in what sequence the individual components should be connected with the bus-system. For example, the central control apparatus, by means of signal-output, may designate each work-station, at which the next component is to be connected to the bus system.

So that, for instance, a component can be tested after its connection to determine if the connection of the component has been executed without fault, it is of advantage, if the recognition phase for a further component is delayed in its initiation.

The recognition phase can be accomplished and carried out in different ways, for instance in accord with an improvement of the invented procedure by the conversion of the default address into an initializing address, which, in turn, is to be converted to the final component-specific address.

In a more practical manner, the recognition phase may be released by the connection of a component onto the bus-system, or by the activation of an element or circuit included for this purpose, the corresponding component is provided with the control voltage or a release signal is given for this purpose.

If it has been determined by a read-release of the central control apparatus, that a component-specific address, or a default address is lacking, then, in an advantageous embodiment of the invented procedure, the corresponding component is registered as being absent.

So that the person, who has instigated the recognition phase, is made aware as to whether an effective execution of the conversion of the initialization address into a component-specific address has been carried out or not, in a further development of the invented procedure, a display of the successful completion of this conversion is provided.

In order that disturbances, which can occur for many reasons, are set aside at an early point, that is, avoiding ahead of time the damages caused by such disturbances, another advantageous development of the invention provides that upon lack of an answer to a transmitted read-request from the central control apparatus, after a specified time:

- a sending of the read-request to the corresponding individual control apparatus is carried out, and/or
- the individual control device stops the component assigned to it, and/or
- the component-specific address of the corresponding individual control device is retrograded to a default address, and/or
- a fault alarm will be released.

Such a procedure is not only of advantage when employed in common with the preceding embodiments, but can be used of itself independently of the features of said embodiments.

A particularly sensitive control method on an open-end spinning machine, is the start operation. This is so, because the start operation, at the moment of incorporation between a thread-end fed to a spinning element and the newly spun thread therein, should so proceed, that a thread so joined in this manner, should be indistinguishable in regard to appearance and strength, from other threads. This advantage is achieved by features of the invention wherein for the feeding of fibers in accord with the desired bulk run of a starting thread, corresponding specified inputs have been provided, which, because of predetermined rules for set values, were changed for the determination of the control of the start and/or the acceptance of the feed of fibers to the spinning element. Again, this procedure is of value of itself as well as in connection with the foregoing claims.

The start operation is of a complex nature, and is susceptible to change from a multiplicity of factors. By considering these factors, a development of the invented procedure improves the effects of the start operation. For example, the specified values, which were changed into set values, are brought in particularly for the beginning and/or the rapidity of the return delivery of a thread end into the spinning element and/or its withdrawal from said spinning element and/or the acceleration of the previously braked spinning element. In accord with the invention, this spinning procedure can be further improved, in that the bulk run in the provided start-thread is measured, and upon a deviation of the determined bulk run from the desired set value of said bulk run, then the set values and/or the predetermined rules are correspondingly changed, or further values, which influence size of said bulk run, are measured, in particular the relative humidity of the air and/or the rotational speed of the spinning element, and/or the thickness of a fiber band being fed for its disintegration into fibers and are included for the correction of the specifications and/or the predetermined rules. Along with this, it is of advantage, of these control-related optimizations are such that the set values from the input values and the specified rules are determined with the aid of fuzzy logic, or the set values are self-optimizing.

During the operation of a textile machine, for different reasons, a brief or lengthy power failure can occur. Obviously, in this case, the necessary voltage is not available for an orderly running of the textile machine. To prepare for a case where only a brief dropout of voltage occurs, and to avoid a stoppage of the textile machine, in accord with an embodiment of the invention, an auxiliary voltage is made available with short-time availability for a controlled shut-down of those components which contribute to the product of the textile machine, and upon renewed availability of said voltage a controlled return to running speed of these said components is released. This auxiliary voltage is generated for a short, specified period, for instance, by the inertial force of the machine which is still in motion. With this auxiliary help, the components, which determine the quality of the textile machine products, that is, a fiber band or a thread, maintain their correlated speeds so that no great deviation occurs in the properties of the products from their normal condition.

The auxiliary current source, as well as the inertial mass which furnishes the auxiliary current, continuously loses, corresponding to the duration of the current downtime, more and more energy, thereby reducing machine speed. Thus, the voltage required for the control and the drives of the components producing a product intended to be uniform in its characteristics, can only be maintained for a short period. In accord with the invention, on this account, after the overstepping of a specified time interval, the synchronous speed relationships can no longer be upheld and the shut down is continued without control and/or a braking of the components is released.

When the time comes for a component to be re-activated, then, this is carried out, advantageously from the central control apparatus.

For the execution of the above described procedure, an apparatus in accord with the invention is provided, wherein, in a simple and safe manner, a quick reassignment of component-specific addresses for the individual control device is made possible. Each component is assigned to an individual control device which is connectable by a bus system to a central control apparatus in which a pre-input default address is changeable by the central apparatus into a component-specific address by means of a bus system with a central control apparatus connectable thereto.

Advantageously, the work-station possesses a signaling device, which can signal the state of operation to the central control apparatus and/or can signal as well faulty functioning.

Advantageously, the components have a time delay for a retarded entry of the recognition phase.

Advantageously, the central control apparatus is programmable in such a way, that upon the recognition of duplicate addresses and/or of addresses which deviate from the assigned component-specific addresses, all component-specific addresses are made to revert to the default address. This embodiment brings about the possibility of creating the same output basis for a new assignment sequence of component-specific addresses. This is done independently of which component-specific address has already been assigned to a newly installed component—i.e. its control device—by exchange. A duplicate issue of component-specific addresses is definitely excluded by means of an automatic resetting of all the component-specific control devices assigned to the central control apparatus to a default address.

As already mentioned above, the recognition phase can be made available for the determination of a component-specific address through the connection of a component and its individual control device to a bus system which is in communication with the central control apparatus. In order to be able to carry out the installation of individual components and their individual control devices independently of the component-specific addresses assigned to them, it is advantageous, if the individual control device has a release element assigned to it. With the aid of this release device, the recognition phase for a specific component can be realized at a optional point of time and independently of the installation. In doing this, it is advantageous if various functions can be carried out with one and the same circuitry, wherein each function is triggered by the duration of its activity. In the intervening time an initializing address for those components to be recognized can be assigned.

In a favorable development of the apparatus in accord with the invention, a display device is provided which shows the successful achievement of the assignment of a component-specific address. This display device can be designed for the purpose in various ways.

The central control apparatus and the individual control devices are in continual data exchange during the operation of the textile machine in order to monitor the faultless running of the components under the regulation of central control apparatus. As this goes on, an embodiment advantageously provides that upon any disturbance of this data exchange, an appropriate function is released, whereby the central control apparatus communicates with a fault display apparatus.

As already stated, the individual components can be designed differently. These differences, among other things, depend on the type of textile machine. In accord with a preferred embodiment, in an open-end spinning machine, the components to be controlled possess a drive motor for a feed roll. A feed roll of this kind is a component, which is functional in the final quality of the thread produced during the spinning process.

The roll is especially of integral importance in the start-procedures to be executed after an interruption in the spinning process. In order to carry out this start operation in an optimal manner, advantageously, the invented apparatus is designed in that the individual control device and/or the central control apparatus of an open-end spinning machine having a spinning element is assigned to an input apparatus for the input of the desired bulk run corresponding to the preset values to be generated by a re-start thread, which can then be input into the control device and which are transposable into set values for the control of the start and the rotational speed of a drive motor for a feed roll contained in a component. Once again, the advantageous features of this embodiment are also valid independently of the features of the foregoing embodiments.

It is desirable, that the achievement of the start procedure and the results of the start operation are not solely dependent on the operation of the feed apparatus, but are also based on several additional components. To this end, it is of advantage for obtaining an optimal start operation if the individual control device of the feed roll is provided with a controlling communication to the other components taking part in the start-procedure at this work-station. In addition, in accord with a further improvement of the invented apparatus, it is advantageous if at least one measuring instrument for the further optimization of the start operation be provided.

In order to achieve a further developing optimization of the start operation, advantageously, an evaluation of the transmitted or received values is provided. The individual control device, or central control apparatus, is so designed that the predetermined set values input by means of the input apparatus are changeable because of the determined measurement values, and which changed quantities can be input into the program and by means of which the program in the individual control device and/or the central control apparatus is changeable. If this is done, advantageously, the evaluation and/or the work-up of these values with the aid of the invented apparatus can be carried out by an individual control device or central control apparatus operating by fuzzy logic.

So that, in the case of a current failure of a few seconds, the textile machine need not interrupt its production, the invention is further developed wherein the central control apparatus is connectable with a voltage monitor which supervises the electrical voltage of a utility line current source, as well as connectable with an auxiliary current source, and by means of which, upon the failure of the voltage, with the aid of the individual control devices and the central control apparatus, as well as with the help of the delivered current of the auxiliary current source, a controlled shut-down of all components which are connected to the central control apparatus and have influence on the produced product, and further, upon the reestablishment of the voltage, a controlled bringing of these said components up to operating speed can be carried out with the help of the current supplied by the utility line. The features of this embodiment are of advantage not only in connection with the foregoing embodiments or some of them, but also of useful value in connection with other features, not mentioned in the foregoing embodiments. Should, within the period of these few seconds, the normal voltage not restore itself, in that case, then the further synchronous shut-down of the components which are contributory to the quality of the products produced by the textile machine can be dispensed with. This can be carried out by an embodiment wherein the central control apparatus is assigned a time measurement control by means of which the braking devices assigned to these components can be activated and/or the auxiliary current source as well as the controlled shutting down of the components which influence the product made on the textile machine can both be switched off by the central control apparatus upon an overstep of the pre-specified time-span.

For the start-up of a component, in accord with the invention, an improvement of the invented apparatus is provided wherein by means of the central control apparatus an "ON" signal can be given to the individual control devices on the basis that the components assigned to the individual control devices are startable.

The procedure in accord with the invention as well as the apparatus complying with the present invention make possible, in a simple manner, the correct assignment of individual control devices to the central control apparatus equipment. Besides this, with the help of this procedure and this apparatus, a well controlled run of production is enabled and is optimized in a precise and simple way, even in the course of a short time voltage fallout.

Embodiment examples of the invention are explained in more detail in the following with the aid of the drawings.

DETAILED DESCRIPTION

Figure 1:
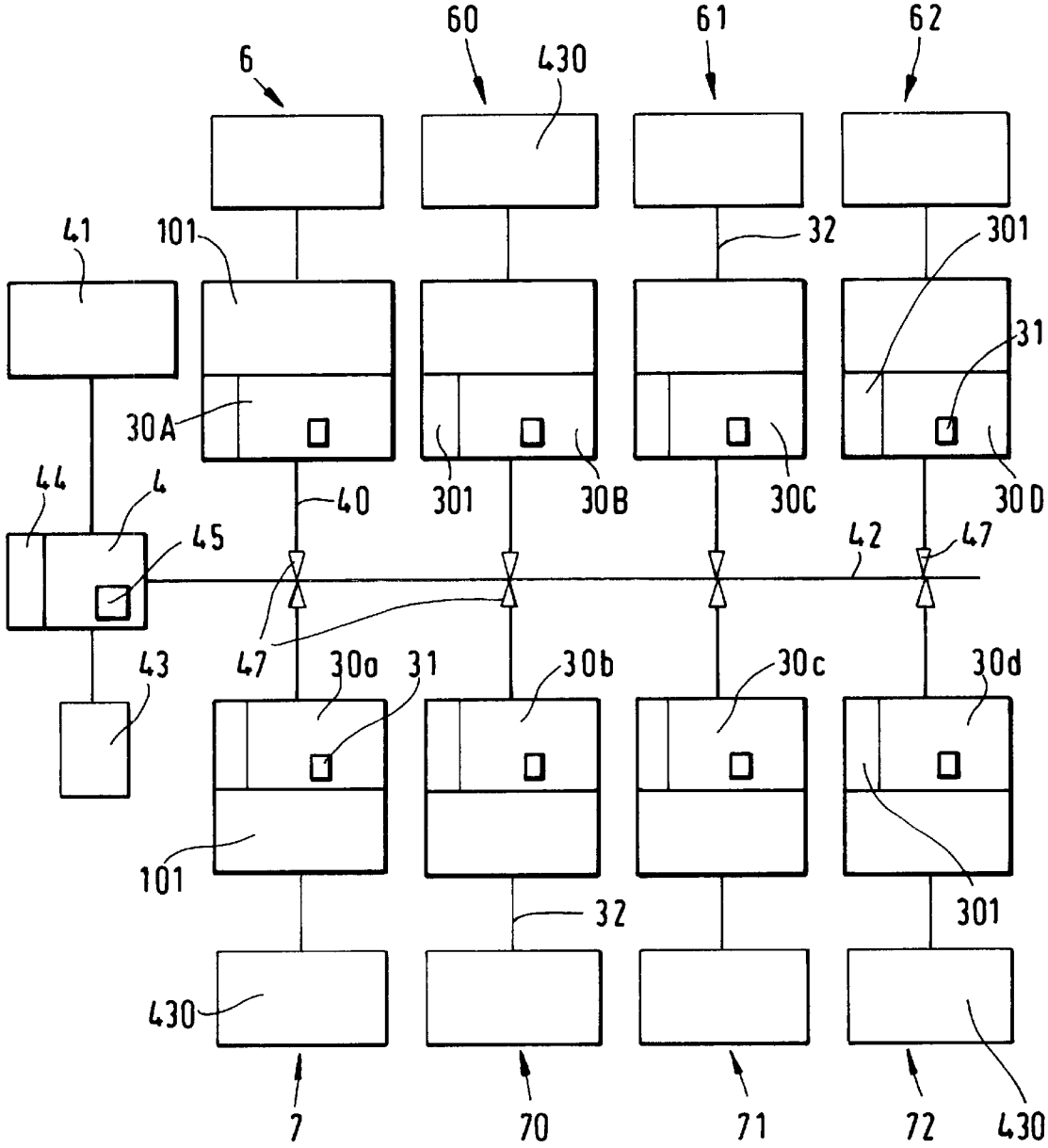
FIG. 1 a plurality of components, which are in communication with a central control apparatus by means of respective individual control devices connected to a common bus system, FIG. 2 a flow diagram of the steps of the invented procedure for the determination of component-specific addresses for the individual control devices of the components, FIG. 3 a flow diagram of the steps of the invented procedure upon the occurrence of a disturbance, FIGS. 4, 5 respectively, a flow diagram of the steps of the invented procedure for the optimization of a start operation on an open-end spinning machine, FIG. 6 in a schematic cross-section, an open-end spinning apparatus designed in accord with the invention, FIG. 7 a flow diagram for a conversion of the procedure shown in FIG. 2, and FIG. 8 a flow diagram for a conversion of the procedure shown in FIG. 7.

Reference will now be made in detail to embodiments of the invention shown in the drawings. It should be understood that such embodiments are provided as a way of explaining the invention, and are not meant as a limitation of the invention. Modifications and variations can be made to the embodiments described herein which are within the scope and spirit of the invention.

Figure 6:
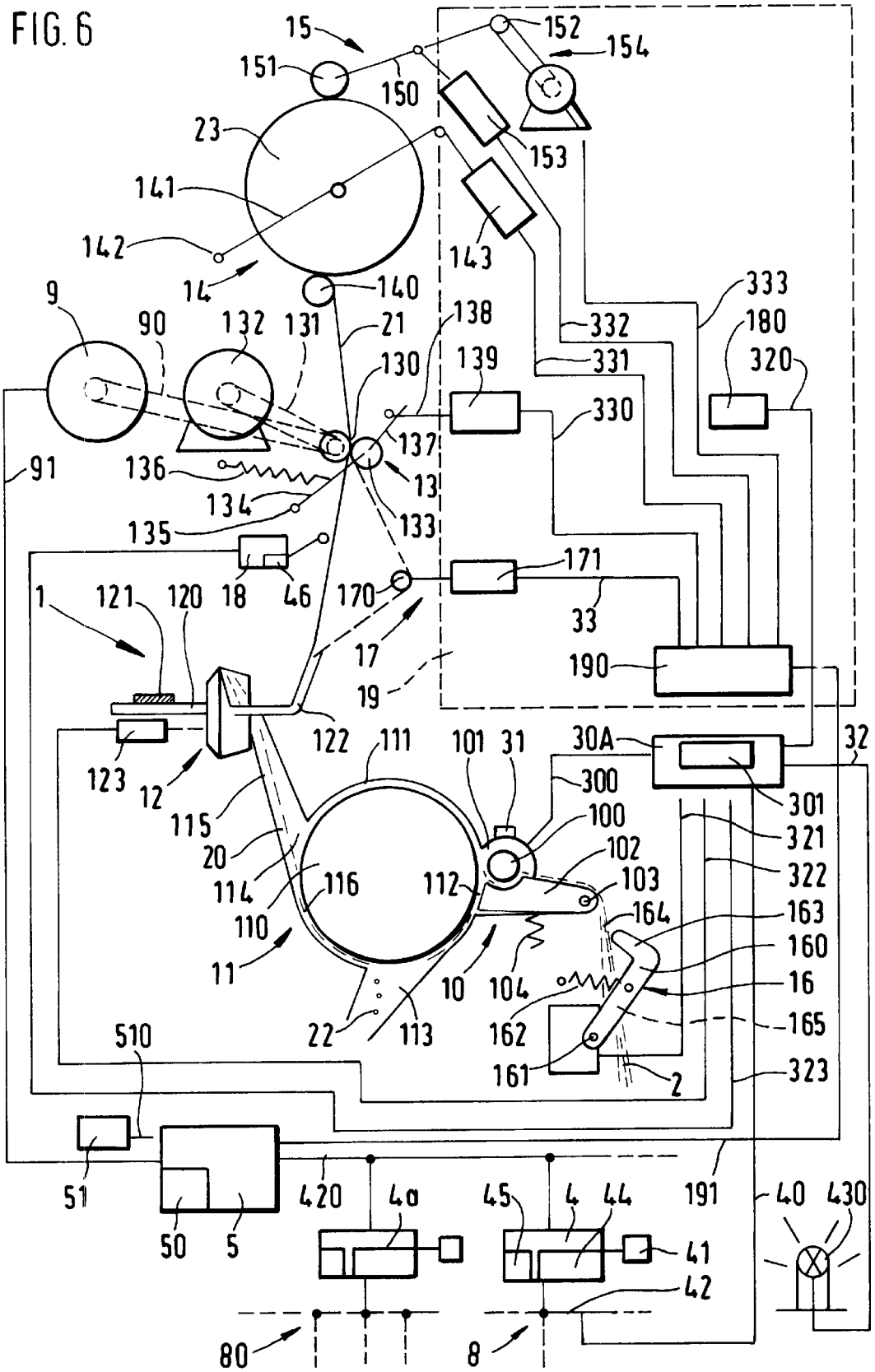

Before the procedure of the invention is discussed , first, the essential elements of an open-end spinning machine 1 as shown schematically in FIG. 6 should be described as an example to indicate how such a procedure is carried out. It is self-explanatory, that such a procedure can be used—with appropriate adaptions—on other textile machines, if these machines likewise possess a multiplicity of similar work-stations in their construction. Such similar machines where this would be the case would be, for instance, ring spinners or other conventional or unconventional spinning machines, such as wrap spinning machines. Even in the case of an open-end spinning machine, the realization of the procedure which, in the following, is described in detail is not limited to the special design of an open-end spinning machine such as the rotor spinning machine, but the procedure is applicable also to friction spinning machines, electrostatic spinning machines or air spinning machines.

Independent of the special design of one of the aforementioned textile machines, such machines possess, at least along the longitudinal side of the machine, a multitude of work-stations 6, 60, 61, 62, . . . (FIG. 1) with respectively a spool or spinning machine, wherein each exhibits a plurality of controlled components. In addition, generally along the second longitudinal side of the machine, a further number of work-stations are provided, namely 7, 70, 71, 72, . . . .

Selected as an example, a typical open-end spinning machine 1 is depicted in FIG. 6. This open-end spinning machine 1 possesses as components: a feed apparatus 10 for the introduction of a fiber band 2 to a disintegrator or opening arrangement 11, by which the fiber band 2 is reduced to single fibers 20; also, a spinning element 12 which consolidates the single fibers 20 delivered to said spinning element 12 from the disintegrator 11 into a forming thread 21, which, by means of thread removal apparatus 13 is withdrawn from the spinning element 12 and proceeds to a spooling apparatus 14 for the formation of a winding on spool 23. Further components or auxiliaries, such as, a band guide 16 leading the feed apparatus 10, a thread return-delivery 17, a thread monitor 18 or an auxiliary drive arrangement 15 for powering the spool 23 during the start up or beginning phase, are all, as a rule, additionally provided.

These components and auxiliaries will be gone into later, as this becomes necessary for the explanation of the procedure.

Of the named components, some are placed on a service apparatus 19 (outlined by dotted lines in FIG. 6). This apparatus travels longitudinally along the multiplicity of work-stations 6, 60, 61, 62, . . . and/or 7, 70, 71 72, . . . and stops at any one position which requires attention. The mentioned apparatuses or components of such a work-station, 6, 60, 61, 62, . . . and/or 7, 70, 71 72, . . ., each in accordance with the kind of a machine, its special construction and degree of automization, can deviate from the special designs which are detailed in the following. The described embodiments below are accordingly to be understood as examples to enhance the explanation.

The spinning element 12 can be made in different designs and, for instance, can comprise several elements, for instance two friction rolls, which co-act to form a thread 21. The spinning element can also be provided as a stationary chamber, in which a pneumatic or magnetic field rotates and in this way produces the necessary torque for the formation of a thread 21. To suit the arrangement chosen to be the embodiment for FIG. 6, the spin element 12 is designed as a spin rotor.

The feed apparatus 10 serves the purpose of bringing a fiber band 2 to the disintegrator apparatus 11. For this purpose, the feed apparatus 10 is comprised of a feed roll 100, which can be driven with the assistance of an individual drive in the form of a drive motor 101. In addition, a feed basin 102 is present, which is pivotally supported on a bolt 103. By means of a compression spring 104 which is appropriately anchored on a stationary part (not shown) of the open-end spinning-machine 1, the said feed basin 102 is loaded in such a way that it clamps a fiber band 2, which is being guided to the disintegrator, between itself and the feed roll 100.

The disintegrator 11 possesses a fiber band disintegrating roll 110 which is equipped with a (not shown) saw tooth sheathing, this being located (but only indicated in FIG. 6) in a housing 111. Between an entry feed opening 112, through which the forward end of the fiber band 2 is fed to the disintegrating roll 110 through the feed opening 10, and a fiber exit opening 114, onto which the machine fiber feed conduit 115 connects, is, as a rule, found a contamination reject opening 113 in the inside circumferential wall of the housing 111. This reject opening 113 serves for the removal of dirt particles 22 from the fiber air stream which flows from the entry feed opening 112 to the fiber exit opening 114 along the circumferential wall 116 of the housing 111.

The fiber feed conduit 115 opens, in accord with the design of the spinning element 12, i.e in this instance, into the spin element 12. A spin element 12 designed as a spin rotor (see FIG. 6) is located in a (not shown) chamber and exhibits a rotor shaft 120 set on bearings in a (not shown) certain manner. With the help of the said rotor shaft 120, the spin-element 12 designed as a spin rotor, can be driven. For this purpose the following can be named, a drive element, namely a friction wheel, a drive belt 121 or the like, possibly even one of a multiplicity of belts (in some cases 2), or a brake for acting on the rotor shaft 120. It is also possible that an individual motor drive can be employed (single drive) for the spin element 12.

For the guiding of the thread 21 during its reversal for introduction to a start operation, that is, during its later withdrawal, a thread removal tube 122 has been provided.

The thread removal apparatus 13 exhibits a fixed withdrawal roll 130, which, for instance, with the help of an overdrive 131 is connected with a drive motor 132. With the stationary withdrawal roll 130, a pressure roll 133 operates in conjunction therewith. Pressure roll 133 is borne upon a lever 134. The lever 134 is pivotally linked to swing on an axis 135, and by means of a tensioning spring 136 is loaded in such a manner, that the pressure roller 133 is held flexibly in location on the driven withdrawal roll 130.

The lever 134 is extended out over the bearing position of the pressure roller 133 and possesses a free end 137, with which a lifting element 138 can be engaged and which is in connection with a lifting drive 139.

The spool apparatus 14 possesses a driven spool roll 140 on which, during production, the spool 23 rests. The spool 23 is rotatably supported between two spool arms 141, which arms, on their own, are pivotably carried on a swinging axle 142. A lifting apparatus 143 is provided to the spool arms 141.

The spool apparatus 14 is, further, assigned to the already mentioned auxiliary drive 15, which is essentially comprised of a pivoting arm 150 with a drive roll on its free end. The pivot arm 150 is set on a swinging axle 152, which is served by a pivot-drive 153. With the help of this drive, the drive roll 151 is swung into driving contact with the said spool 23 or can be again raised away from said spool. The spool 23 can be driven with the help of the auxiliary drive mechanism 15, which, for this purpose, possesses a drive 154 which powers the drive roll 151 through said arm 150.

The components, previously described as to their construction operate in the conventional manner. A fiber band 2, with the aid of the feed apparatus 10 is fed into the disintegrator 11, which combs out separated fibers 20 from the incoming fiber band 2 These, picked up by the suction which is in force in the spinning element 12, are carried into the fiber feed conduit 115 and gain entry into the said spinning element 12. The spinning element 12 is designed as a spin rotor. In this spin rotor, the said fibers are consolidated into the form of fiber-spirals and continuously entwine into the end of the outtake of the thread 21. The thread 21, which exits the spin element 12 through the thread removal apparatus 13, reaches the spool 23, which is in a driven rolling contact with the spool roll 140 and said thread 21 is thereby continuously wound onto said spool 23. It is self explanatory, that the thread 21, in this operation, by means of the intervention of a (not shown) traverse apparatus, is laid on the spool 23 in orderly end to end overlap.

The procedure should next be discussed from the standpoint of a component formed by the feed apparatus 10, on which account, the control-related connections thereof should be described. The drive motor 101 for the feed roll 100 is in connection with an individual control device 30 through a control line 300. This control device 30 is itself in communication with a central control apparatus 4 by means of connection line 40.

Open-end spinning machines are comprised, as a rule, of two end frames (not shown) in which various drives, such as a main control apparatus 5 (FIG. 6) are installed, as well as a multiplicity of similar sections 8, 80, . . . , of which each possesses a central control apparatus 4, 4*a*, . . . as a section central control apparatus in common for the combined work-stations (6, 60, 61, 62, . . . and/or 7, 70, 71, 72, . . . ) of this section 8, 80, . . . Each work-station, namely, 6, 60, 61, 62, . . . and/or 7, 70, 71, 72, . . . possesses an open-end spinning machine 1, of which the feed apparatus 10 is a component.

The control-related connections are presented schematically in FIG. 1. This illustration shows besides the central control apparatus 4 of the section 8, a clock 41 as well as a bus system 42, by means of which a plurality of individual control devices 30A, 30B, 30C, 30D, . . . , and if needed, 30*a*, 30*b*, 30*c*, 30*d*, . . . are placed in communication, utilizing the help of connection elements 47 (FIG. 1), which are usually in the form of plug-in sets. As is evident from, FIG. 1, the individual control devices 30*a*, 30*b*, 30*c*, 30*d*, . . . are on one long side of the machine and the individual control devices 30A, 30B, 30C, 30D, . . . are on the other long side of said machine, all respectively arrayed next to one another.

In the interests of clarity and simplicity, in the following, often the reference designations of the individual control devices of one of the two sides of the machine are named, i.e. 30A, 30B, 30C, 30D, . . . of work-stations 6, 60, 61, 62, . . . , wherein it should be understood that this also encompasses the case of a textile machine with workstations on both longitudinal sides of the machines, that is, work-stations 7, 70, 71, . . . and their individual control devices 30*a*, 30*b*, 30*c*, 30*d*, . . . on the other longitudinal side of the machine.

With each of these individual control devices 30A, 30B, . . . is, respectively, a component associated, which, in the present instance is designated as "feed apparatus 10".

In the case of the installation of a textile machine of the described type, first the sections 8, 80, . . . as well as the end frames are built together. Subsequently, the main control apparatus 5 is next on the queue, with which the central control apparatus 4, 4*a*, . . . , is connected by means of a bus system 420 (see FIG. 6, not shown in FIG. 1).

The feed apparatuses 10, with their individual control devices 30*a*, 30*b*, . . . and/or 30A, 30B, 30C, . . . are not put in place during the machine installation until after the central control apparatus 4, 4*a*, . . . of a section 8, 80, . . . is shown to be functional. When this is carried out, it is important, that the single, individual control devices 30*a*, 30*b*, . . . and/or 30A, 30B, . . . are assigned component-specific addresses, since, it depends on these addresses, as to whether or not in the case of a required service visit, the mobile service apparatus 19 actually serves the correct work-station 6, 60, 61, 62, . . . .

The assignment of component-specific addresses to a component will be described in the following with help from FIG. 2. In this flow diagram, the basic procedure steps are characterized by heavy contours and lines, while the procedure steps, which are essentially non-obligatory, that is their installation is optional, are presented with lighter contours and lines.

First, the individual control devices, 30*a*, 30*b*, . . . and/or 30A, 30B, 30C, . . . of the components to be included in the installation, are to be assigned a default address. If now, during the installation of a component at a desired work-station 6, 60, 61, 62, . . . the attendant individual control device 30*a*, 30*b*, . . . and/or 30A, 30B, 30C, . . . is connected to the bus system 42, (work step A), then in this way, a recognition phase is initialized (work step B). Next, at this point, the default address is transposed into an initiating address (work step C). The central control apparatus 4 . . . , is now in possession of a timing provided to it by the clock 41. Accordingly, central control apparatus 4 now cyclically interrogates the control devices assigned to it, namely 30*a*, 30*b*, . . . and/or 30A, 30B, 30C, . . . .

The central control apparatus 4 now determines, upon its next interrogation, if a control device 30*a*, 30*b*, 30*c*, . . .

and/or 30A, 30B, 30C, . . . is new on the line and registers this if necessary and assigns to the number a component-specific address (work step D), by means of which the initialization address is replaced. Under the concept "component-specific address" that address is to be understood, which, within section 8, 80, . . . , for each component is only to be granted once. In this way and manner, the determination is unchangeably fixed, in regard to which component in an open-end spinning apparatus 1 is involved and also within which open-end spinning machine of a section 8, 80 it is to be found.

If the central control apparatus 4, 4*a*, . . . has the component-specific address fixed, then the said central control apparatus 4, 4*a*, . . . can determine on the basis of the registration, whether or not all component-specific addresses have been issued (work step E). If this is not the case, (see the minus sign in work step E), then the central control apparatus 4, 4*a* interrogates the individual control devices 30*a*, 30*b*, 30*c*, . . . and/or 30A, 30B, 30C, . . . anew, and upon the determination of a new initialization address for the component in question, assigns a corresponding component-specific address (work step D). The work steps D and E will be reiterated until all component-specific addresses have been issued (see the plus sign following work step E). When this is accomplished, then the interrogation is ended (work step F). As will be later discussed in connection with FIG. 3, this work step F can simultaneously serve as the transition point for another program.

The introduction of the recognition phase (work step B) can, as is described above, be circumvented during installation of a component by the connection of its control device 30*a*, 30*b*, 30*c*, . . . and/or 30A, 30B, 30C, . . . through a connection device 47 onto the bus-system 42. Since the central control apparatus 4, 4*a* cannot, with its own resources, differentiate which work-station 6, 60, 61, 62, . . . and/or 7, 70, 71, 72, . . . is brought to attention, a rule for the sequence queue of the preferred connections is provided for the said central control apparatus 4, 4*a*. In view of this, it becomes necessary to connect the individual components onto the bus system in exactly that said sequence queue, with which the central control apparatus 4, 4*a* will coincide.

In order to make the determination of the component-specific addresses independent of the installation of the components and the connection of their individual control devices 30*a*, 30*b*, 30*c*, . . . and/or, 30A, 30B, 30C, . . . , provision can be made, that the recognition phase (work step B)—along with the work steps C and D—is not released by the connection of the individual control devices 30*a*, 30*b*, 30*c*, . . . and/or 30A, 30B, 30C, . . . to the bus system 42, but by the intervention of a special release element 31 (see FIGS. 1 and 6). This release element 31 can be designed in various modes, and if required, be an integral part of the component. For instance, the release element 31 can be formed by the feed roll itself For this purpose, the feed roll can be provided with a knob so that a turning of the same (by the operating person) activates a situation in which the recognition phase (work step B) is released. However, also a light relay or infra read circuit or the like, would also be suitable for this purpose.

An additional alternative will now be described, with reference to FIG. 6. In this case the release element will be formed by the pivotably supported band guide 16. The band guide 16 exhibits, for instance a bent lever 160, which is pivotably secured on a bolt 161 secured in a stationary element in the open-end spinning machine. The lever 160 is loaded by a tensioned spring 160 in such a manner, that its free end 163 is held in position on a flat surface 164 of the open-end spinning machine 1. In this way, the fiber band 2 is clamped between the lever 160 and the surface 164, without, however, in any way interfering with the drawing of the fiber band 2 through the rotation of the feed roll 100. Between its two ends, the lever 160 possesses a guide opening 165 for the fiber band.

If now, the lever 160 of the band guide 16 moves beyond the normal set point, which represents the normal thickness variance of the fiber band 2, then this excess of movement is utilized for the sending of a signal which initializes the recognition phase (work step B).

Figure 2:
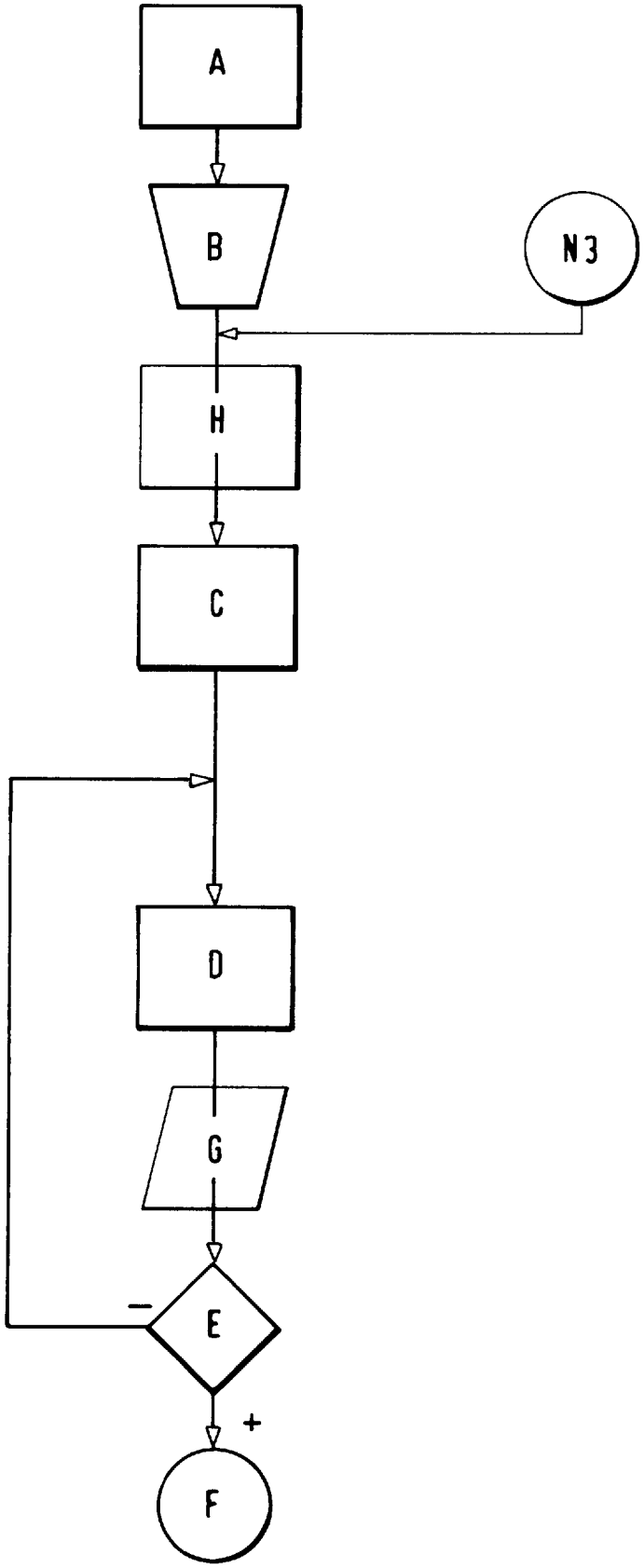

It is also possible to announce to the operating person whether the assignment of a component-specific address to the newly initialized component has faultlessly functioned (see work step G in FIG. 2).

Since the recognition phases, which encompass the work steps C and D, occur sequentially (see FIG. 2) it suffices, for the avoidance of exchange, if essentially the central control apparatus 4, 4*a*, . . . of the section 8, or 80 etc. is provided with a central display/announcement apparatus 43 as is demonstrated in FIG. 1. As an addition, or as an alternative, it is still a possibility, to assign to each work-station 6, 60, 61, . . . and/or 7, 70, 71, . . . its own display apparatus 430 (see FIGS. 1, 6), which, by means of a line 32 is in communication with the individual control device 30A, . . . .

The display apparatus 43 and/or the display apparatuses can, in different versions, be designed as acoustic or optical signal emitters of conventional construction. In the case of the arrangement of the display apparatus on the work station 6, . . . and or 7, . . . , itself, a further possibility becomes possible . Instead of the activation of a conventional signal output device, namely, the components in question can be, for a short period, set into operation, to gain the result that a successful achievement of a establishing a component-specific address is indicated.

In the above described case, the short-term operated component itself serves as a display apparatus. Obviously, this can only be carried out with such components where no danger can ensue. This is the case with a feed roll 100, since this roll is placed in a recess of the housing 111 of the disintegrator 111 and is thus external to the normal working zone of an operating person.

FIG. 6 indicates a further possibility of a display apparatus 46, which is designed as an integral part of the thread monitor 18 and, for instance, possesses one or more (multi colored) light diodes. The thread monitor 18, fashioned also as a sensor, can be designed to take over the task of quality supervision of the thread and thus be one of the invented components subject to control.

Under certain conditions, for instance in the case of a general overhaul, etc., it can become necessary to replace more than one individual component, for instance, the feed apparatus 10, with other components, which have previously been checked out or repaired.

The newly repaired and now installed components, or some of them, still exhibit, generally, the original component-specific address, which was assigned to them by the corresponding central control apparatus 4, 4*a*, . . . during their earlier operation. So that disturbances during future operation are excluded, especially by a duplicate issue of a component-specific address, it is therefore a requirement, that—if the component-specific address is to be retained—the corresponding component is brought once again to the installation procedure at the work station 6, 60, . . . and/or 7, 70, . . . , for which the already issued component-specific address has been provided. This means, however, an entirely exact examination of the component to be installed and brings about the said danger of a duplication.

In order to exclude the said risk, the following procedure is of advantage:

If the central control apparatus 4, 4*a*, . . . determines that an individual component has been taken from it, this deficiency is registered. Likewise, if no other component has been subtracted from the registry, as substitute for the removed component, a new component is installed. In this case, the central control apparatus 4, 4*a*, . . . interrogates to see if the newly installed component possesses the same component-specific address which was assigned to the previous, now removed component.

If the answer is yes, then the central control apparatus 4, 4*a*, . . . accepts the new component, without the necessity of changing a component-specific address. If the central control apparatus 4, 4*a*, . . . however, determines that the component-specific address deviates from that of one of the removed components, then the central control apparatus 4, 4*a*, . . . replaces, on its own, the component-specific address of the newly installed component, with that component-specific address which had been previously assigned to the now removed component.

If several components are removed, without any of these components being immediately replaced by a new component, then the above procedure cannot be made use of. Each time, when the central control apparatus 4, 4*a*, . . . detects the absence of more than one component, then the following procedure is invoked:

If, after more than one component in a section 8, 80, . . . is removed and new components are installed, then the central control apparatus 4, 4*a*, . . . delays, until all lacking components are replaced or until a recognition phase (work step B) has been initialized in the above described manner. As this is done, the central control apparatus 4, 4*a*, . . . places the component-specific addresses of all components of this section 8, 80, . . . or at least all the same kind of components, that is, all feed apparatuses 10, back on the default addresses (Step H—see FIG. 2). The operating person can now, at an optional time, bring into the said recognition phase, all the individual control devices 30A, 30B, 30C, 30D, . . . , and if necessary, 30*a*, 30*b*, 30*c*, 30*d*, . . . in their desired sequence.

In practice, the initialization of a group of components as well as the single exchange both occur. This is to be explained in a further example on the basis of FIG. 7.

Figure 7:
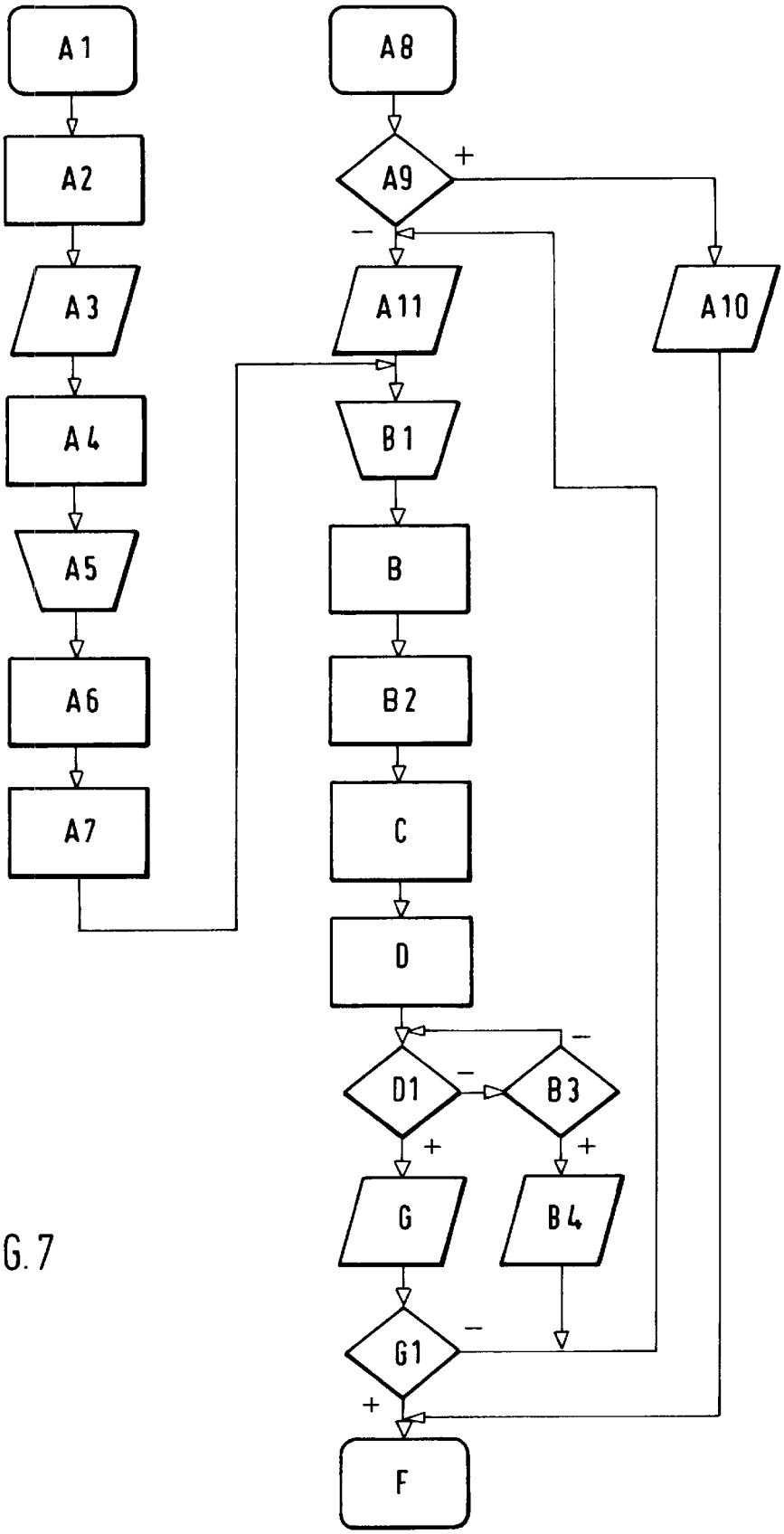

On the left side of FIG. 7, the sequence of events is shown, which take place in the case of a fault, while on the right side is depicted the initializing of a component group (for instance combined components, which are assigned to section 8, 80, . . . and thus the central control apparatus thereof, i.e. 4, 4*a*, . . . ).

If a disturbance comes about (Step A1), then the ensuing results will be recognized by the central control apparatus 4, 4*a*, . . . .

The components are now switched off (Step A2). In the case of, for instance, a component formed by a feed roll 100, then the current supply to its drive motor 101 is interrupted.

If the central control apparatus 4, 4*a*, . . . is designed as a section control apparatus, then provision can be made, that simultaneously with the shutting off of the component in question, a corresponding signal is sent to the main control apparatus 5 (Work Step $A_3$) which over-rides the sectional central control apparatus 4, 4*a*, . . . , where the lack is registered (Step $A_4$). Moreover, the display apparatus 46 (or another display/alarm apparatus) responds and its light diodes are brought to blinking, for instance in yellow and red.

The central control apparatus 4, 4*a*, . . . can be reset into an exchange mode (Step $A_5$), which can occur with the interposition of the release element 31 (FIG. 6) or by means of an overriding control.

With subsequent renewed activation of the release element 31 (FIG. 6) by means of the operating person, the central control apparatus 4, 4*a*, . . . so acts that the individual control device 30*a*, . . . is provided with a default address (Step $A_6$).

The components, which have caused the disturbance, are now removed by being physically taken out (Step $A_7$). A new component with an individual control device 30*a*, . . . is now installed in the vacated work-station 6, . . . (Step $B_1$). After this, the recognition phase is initialized (Step B), which can be done either by the connection element 47, designed as a plug-in element of the individual control device 30*a*, . . . making contact with the bus system 42, or by the activation of a special release element 31 (FIGS. 1, 6).

Along with the introduction of the recognition phase, a time-control device (a part of the individual control device 30*a*, . . . , and on this account not illustrated) is put into action (Step $B_2$). Subsequently, in the manner described above, a component-specific address is assigned to the individual control device 30a (Work Step C/D or accordingly after the above is carried out, then only D).

Next, the central control apparatus 4, 4*a*, . . . interrogates the individual control device 30*a*, . . . as to whether or not this has received a component-specific address in good order (Step D).

If the answer is "yes", (plus sign at step $D_1$) then, the successfully completed assignment of a component-specific address is correspondingly displayed (Step G) for instance by a permanent light of one or more of the light diodes in the thread monitor 18 of the integrated display apparatus 46 (see FIG. 6) of the corresponding component.

In a sequential work step $G_1$, central control apparatus 4, 4*a*, . . . interrogates each of all individual control devices 30*a*, 30*b*, . . . and/or 30A, 30B, . . . , as to whether or not all of its assigned components have been registered. Upon an exchange of an individual component, this work step, however, has no point, since by means of these individual component exchanges, all components to be so exchanged, have already been exchanged. Based on this reasoning, the individual control device 30*a* . . . is immediately switched to the normal mode after the said work step $G_1$ (note plus sign at step $G_1$–step F).

If the answer is, "no", to the interrogation, as to whether or not the new component, that is, its individual control device 30*a* . . . is already registered, (minus sign at step $D_1$) then a determination is made, as to whether the specified time period of the (not shown) time-control device is already run out (see plus sign at step $B_3$) or not (minus sign at step $B_3$). In case of "yes", (see plus sign at step $B_3$) then this individual control device 30*a* . . . , with its components is registered as missing (step $B_4$). However, if the time is not run out, (see minus sign at step $B_3$), then interrogation is made anew, as to whether the registration of this component has been made in the meantime (step $D_1$).

If an entire group of components is installed at one time in Section 8, 80, . . . , which, for instance, is the situation at a first installation, then, even before the installation of the first component, the central control apparatus 4, 4*a*, . . . shifts into an initializing mode (step $A_8$). Subsequently the determination is made, that as to whether or not, at any work station 6, . . . and/or 7, . . . of this section 8, 80, . . . an individual control device 30*a*, . . . with a default address is available (step $A_9$).

To proceed with assurance, that the component-specific addresses are correctly assigned, and that no duplicate component-specific addresses have been given out, the central control apparatus 4, 4*a*, . . . announces every component possibly found in the Section 8, 80, . . . as being in error (see plus sign at step $A_9$).

As previously described, this sets off the alarm on the display apparatus 43 or 46 (possibly by alternate blinking of a yellow and red light-diode) (see step $A_{10}$).

If, in the Section 8, 80, . . . , no components announce themselves, (minus sign at step $A_9$), then the display apparatus 43 or 46 activates that work-station 6, . . . at which the next component is supposed to be installed. (step $A_{11}$).

In order to make possible a smooth running installation, the said installation, or at least the connection of components onto the bus system 42, is carried out in a sequence which arises from the geometry of the machine and its sections. A component-specific address, therefore, is fixed by means of the central control apparatus 4, 4*a*, . . . depending on its spatial placement within the section 8, 80, . . . .

Thus in the Section 8, 80, . . . illustrated in FIG. 1, the components are installed and connected, one after the other, in the neighboring work-stations 6, 60, 61, 62, . . . and/or 7, 70, 71, 72, . . . .

If the installation of the components begins, for instance, at the work-station 7, then, this is called the first work-station, and for which the display apparatus 46 or 47 is called up (step $A_{11}$). Immediately thereafter follow the steps $B_1$, B, $B_2$, C, D, . . . in the same manner as this has already been explained in connection with the exchange of a single component.

After the registration of a component, (step D), the question is asked as to whether all components have been installed. If this is not the case, (minus sign at step $G_1$), then the display apparatus 43 or 46 of the neighboring work-station 70 is activated ($step_{11}$) to indicate that the next component is to be installed at that place.

If all components are installed and initialized (plus sign at step $G_1$), then the initializing mode is terminated and the central control apparatus 4, 4*a*, . . . returns to the normal mode once again (step F).

In accord with an alternative method of operation (see FIG. 8), the possibility also exists for the first installation, before the activation of the initialization mode (step $A_8$), to separate, in a control-related way, the combined individual control devices 30*a*, . . . and/or 30A, . . . from the central control 4, 4*a*, . . . which is assigned to them.

This can be carried out with the help of one of the release apparatuses 31 of the various components or by another circuit (not shown) which, for instance, is provided on the central control apparatus 4, 4*a*, . . . . With this accomplished, the installation of the components can be made in an optional sequence (step $A_{13}$).

After the installation of all components belonging to a common central control apparatus 4, 4*a*, . . . , the initialization mode is activated (step $A_8$). In this way, the individual control devices 30*a*, . . . and/or 30A, . . . , are connected in a specified, timed sequence, one after another, with the overriding central control apparatus 4, 4*a*, . . . (step $A_{14}$). This can be done in various ways, for instance by the automatic or manual suspension of the control voltage or the output of a signal for this purpose, or for instance with the help of the mentioned release element 31 (FIG. 6).

After the above is completed, for the individual control device 30*a*, 30*b*, . . . and/or 30A, 30B, . . . , a time control apparatus (not shown) is switched on (step $A_{15}$).

The individual control devices 30*a*, . . . and/or 30A, . . . which are to be installed, can, for instance, exhibit the default address (step $A_9$), so that they will not be announced as faulty (step $B_4$), or that a new address will be directly assigned to them.

A fault announcement is triggered (step $B_4$), when an individual control device 30*a*, . . . and/or 30A, . . . does not make its presence and address known within a specified time period. Following the step $A_9$, on this account, an interrogation is made to determine if the time period, which has been set by the now energized time control apparatus through step $A_{15}$, has run out (plus sign at step $A_{16}$), or, conversely, if it has not run out (then see minus sign at step $A_{16}$). If the time period has run out, without the announcing of the interrogated individual control device 30*a*, 30*b*, . . . and/or 30A, 30B, . . . of its address, (plus sign at step $A_{16}$), then the breaking off of the initialization of this individual control device 30*a*, 30*b*, . . . and/or 30A, 30B, . . . is released.

Figure 8:
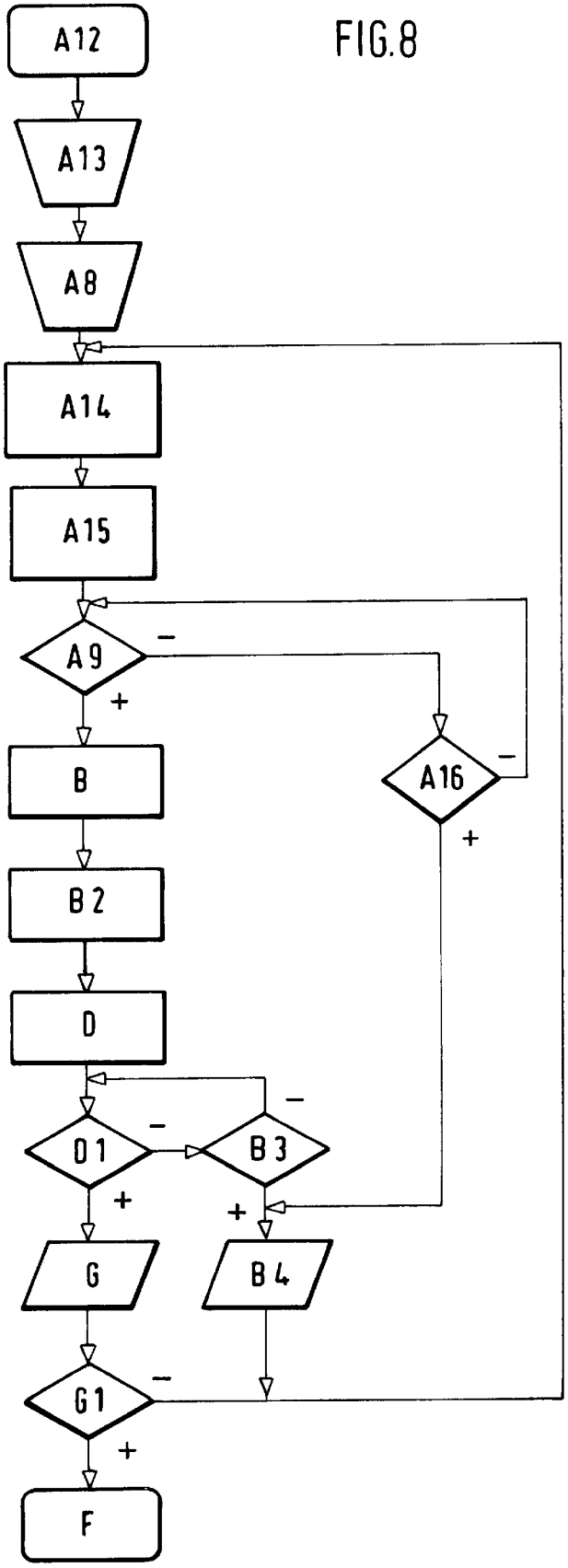

According to the programming of the central control apparatus 4, 4*a*, . . . , at this point a fault display is made (step $B_4$) or, indeed the initialization procedure in its totality is terminated (step F)—this is not shown in the flow diagram of FIG. 8.

If the specified time interval is not run out, (minus sign at step $A_{16}$) then the step $A_9$ is repeated.

By the introduction of the initialization mode, respectively, in a predetermined time period effecting the components, that is, at their individual control devices 30*a*, . . . and/or 30A . . . , the recognition phase (step B) is carried out. In doing this, the further work steps agree entirely, with that which has been discussed in connection with FIG. 7.

If a component, that is, the individual control device 30*a*, . . . and/or 30A, . . . has been recognized, and provided with the corresponding component-specific address (step D), whereby an intervening assignment of an initializing address (step C in FIG. 7) can be dispensed with, then, in this case, following the interrogation per step $G_1$, the individual control device 30*b*, . . . and/or 30B, . . . of the next component is controllably connected with the central control apparatus 4, 4*a*, . . . (step $A_{14}$).

The ensuing work steps continuously reiterate, until finally at step $G_1$ the situation arises that all individual control devices 30*a*, . . . and/or 30A, . . . are registered and thus all components are also ready for operation (plus sign at step $G_1$).

Not only in regard to the procedure in accord with FIG. 7, but also in the case of the procedure in accord with FIG. 8, upon the occurrence of a fault during the initializing phase after the fault registration (step $B_4$) either the initialization is continued or broken off, i.e. terminated (step F). The latter of these two possibilities is not set forth in FIGS. 7, 8, since the operating person is made aware of the fault by means of the alarm given by the display apparatus 43 or 46, and at an later time, the subject component and its individual control device 30*a*, . . . and/or 30A, . . . can be separately initialized, as has already been explained above.

As discussed in connection with FIG. 8, work step C drops out (the assignment of an initialization address), since, because the automatic determination of the sequence for the initialization in accord with step $A_{11}$ or $A_{14}$, it is no longer required to inform the central control apparatus 4, 4*a*, . . . , as to which is to be the next component to initialize, that is, which individual control device 30A, . . . and/or 30*a*, . . . is next on the queue.

As previously explained in detail, with the release element 31 a multiplicity of functions can be activated, whereby the central control apparatus 4, 4*a*, . . . recognizes, dependent on the operational phase, which function is required.

Instead of this (or in addition thereto) provision can be made that upon multiple activations of the release element 31, or triggered by activation times of different durations, even different functions can also be released.

For a time determined suspension of voltage to an individual control device 30*a*, . . . and/or 30A, . . . , the connection element 47 (FIG. 1), equipped with a (not shown) time control element, after the expiring of a given time-period, can suspend the control voltage for its subsequent control device 30*b*, . . . and/or 30B . . . , that is, send a release signal, by means of which the control voltage of the involved, individual control device 30*b*, . . . and/or 30B, . . . is suspended. The activation of the controllable connection element 47 can, however, be carried out by the central control apparatus 4, 4*a*, . . . .

After the components of the section 8, 80, . . . have received their component-specific addresses, then the production can be started. When this occurs, an interrogation program is released (step I—FIG. 3). During production, the central control apparatus 4, 4*a*, . . . cyclically provides its assigned components, for instance the feed apparatus 10 of the individual work-stations 6, 60, . . . , with the specified rhythmic interrogation signal or read-request (step J). The data cyclically sent was input to the said central control apparatus 4, 4*a*, . . . in rhythm established by the clock 41 (FIG. 1). The individual control devices 30*a*, 30*b*, 30*c*, . . . and/or 30A, 30B, 30C, . . . monitor the regular arrival of such read-requests (step K). Should the individual control device 30A, . . . determine the input of a read-request or demand (see plus sign at step K), then it produces a reply signal (step L). In the control center 4, 4*a*, . . . a continuous monitoring is in operation, as to whether or not reply signals enter (work step M) from the single, individual control devices 30*a*, 30*b*, 30*c*, . . . and/or 30A, 30B, 30C, . . . . If the sought for signal does come in (plus sign at step M), then the renewed signal output of a read-request (step J) is released to the corresponding component, that is to its individual control device 30*a*, 30*b*, . . . and/or 30A, 30B, . . . .

The components themselves can monitor the cyclical communication between the individual control devices 30*a*, 30*b*, 30*c*, . . . and/or 30A, 30B, 30C, . . . and the central control apparatus 4, 4*a*, . . . .

Should, as a result of a fault at an individual control device 30*a*, 30*b*, 30*c*, . . . and/or at 30A, 30B, 30C, . . . , or at the central control apparatus 4, 4*a*, . . . no read-request signal be received, (see minus sign at step K), or at the central control apparatus control apparatus 4, 4*a*, . . . no reply be received (see minus sign at step M), then a function (for instance step $N_1$) is released. This function can be of various kinds. For instance, the concern here might be a change in the request, that is, in regard to the alteration or the termination of the output of read-request by the central control apparatus equipment 4, 4*a*, . . . to the corresponding individual control device 30A, . . . .

Further functions, $N_2$, $N_3$, $N_4$, . . . can be provided additionally to or instead of, the break-off of the sending of read-requests ($N_1$). Thus:

step $N_2$, for instance, could recognize the still-stand of components which are assigned to the individual control devices 30A, 30B, 30C, . . . , step $N_3$ could act on the introduction of the reversion of the component-specific address to the default address, and step 4 effects the release of a fault alarm.

This can be carried out with the aid of the previously named display apparatus 43 (FIG. 1) and/or 430 and/or 46 (see FIGS. 1 and 6).

Figure 3:
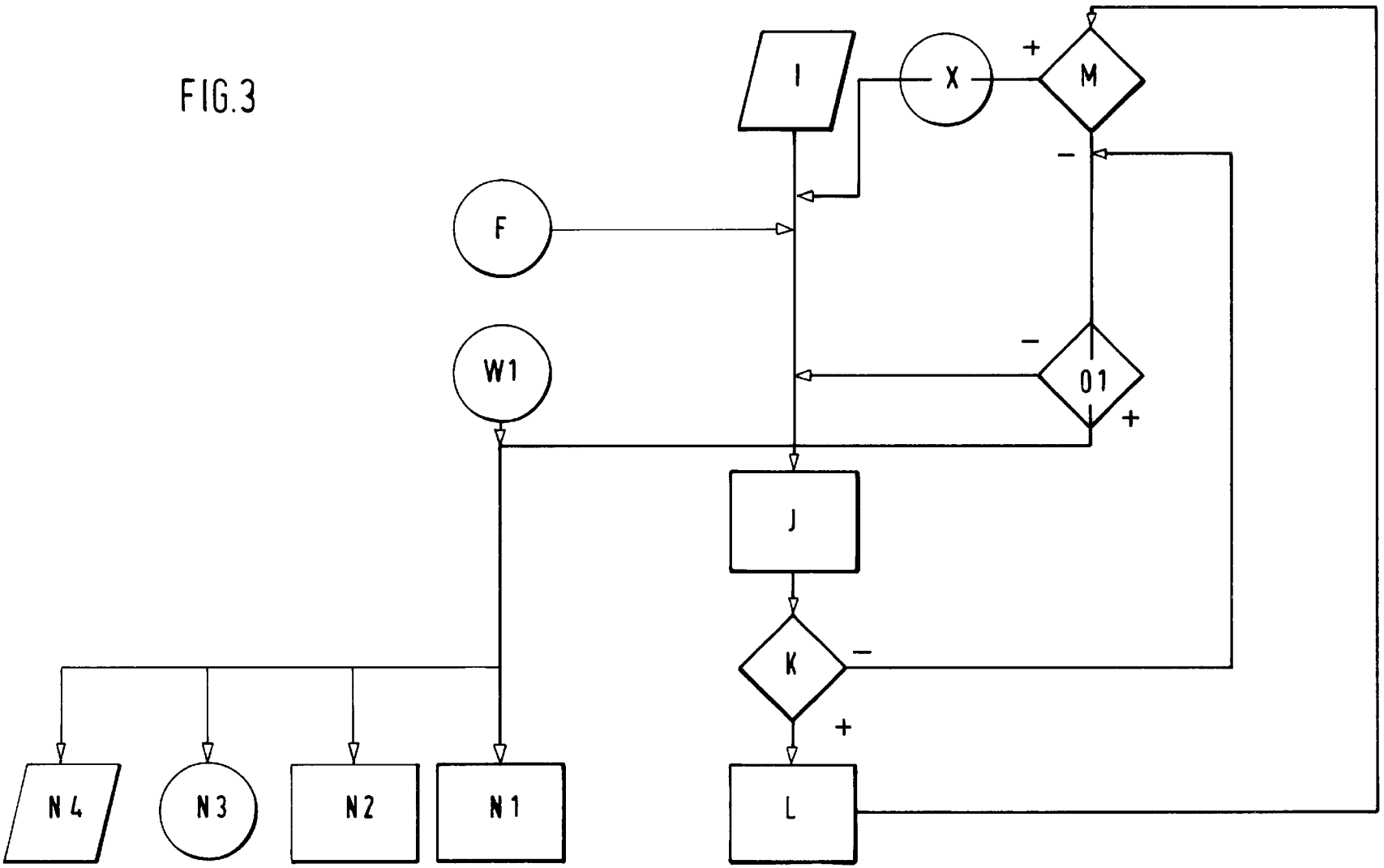

When, in accord with step $N_3$, the reversion of the component-specific address to the default address is introduced, then, with this step $N_3$, transfer is made simultaneously to step H in accord with FIG. 2 and a recognition program is set in force (steps C and D). If the carrying out of the recognition program gives positive results, then, at the work step F (also see FIG. 3) not only the assignments of a component-specific address is completed, but simultaneously, for the corresponding individual control device 30A, 30B, 30C, . . . the interrogation cycle is renewed. This means that—as this is shown in FIG. 3—once again, read-requests are directed to the concerned individual control device 30, 30*a*, . . . (step J), which, have been evaluated in the above described manner.

In order not to react too quickly on minimal disturbances, which perhaps are to be ascribed to short term current pulsations or the like, in accord with the described embodiment examples of the central control apparatus 4, 4*a*, . . . , an adjustable, or preadjusted time delay device 45 is provided (see FIG. 6). This device is set to a specified value, or is preset to said value, wherein, before the expiration of the set period, no function related to $N_1$, $N_2$, $N_3$ or $N_4$ is released. Because of this, in accord with the step M, when the arrival of answer signals are denied, (minus sign at work-station M), the first interrogation is as to whether or not the preset time period has expired (step O). If the said time period has not expired, (minus sign at work step O) then, subsequently, read-requests (work step J) are sent to the corresponding individual control devices 30A, 30B, 30C, . . . .

On the other hand, if the time period has already expired (plus sign at work step $O_1$), then one of the work steps $N_1$, $N_2$, $N_3$ or $N_4$ is activated. Essentially, instead of one of these functions $N_1$, $N_2$, $N_3$ or $N_4$, in accord with the design and/or programming of the central control apparatus 4, 4*a*, . . . , several of these functions $N_1$, $N_2$, $N_3$ or $N_4$ can be simultaneously released.

The service apparatus 19 shown in FIG. 6 possesses a control apparatus 190, which, by means of line 191 is connected to the main control apparatus 5. Relative to this control apparatus 190, there are further connections:

by line 33, connection to the thread return delivery apparatus 17, by line 330, connection to the lift means 139 for the pressure roller 133 of the thread withdrawal equipment 13, by line 331, connection to the lifting device 143 for the spool arm 14, by line 332, connection to the pivot drive for the pivot arm 150, and by line 333, connection to the drive 154 for the drive roll 151 of the auxiliary drive apparatus 15.

As for the single components, which are provided on the service apparatus, respectively, an individual control apparatus (not shown) is provided, which within the service apparatus, is connected by means of a bus-system (also not shown) to the central control apparatus 190 of the service apparatus 19 instead of by the single connections 33, 330, 331, 332, and 333.

The assignment of component-specific addresses for the individual components of the service apparatus 19 and/or for their cyclic interrogation can be carried out in the same manner as this has been described in the case of the central control apparatus 4, 4*a* . . . and the individual control devices 30A, . . . in the Section 8, 80, . . . of the machine.

Figure 4:
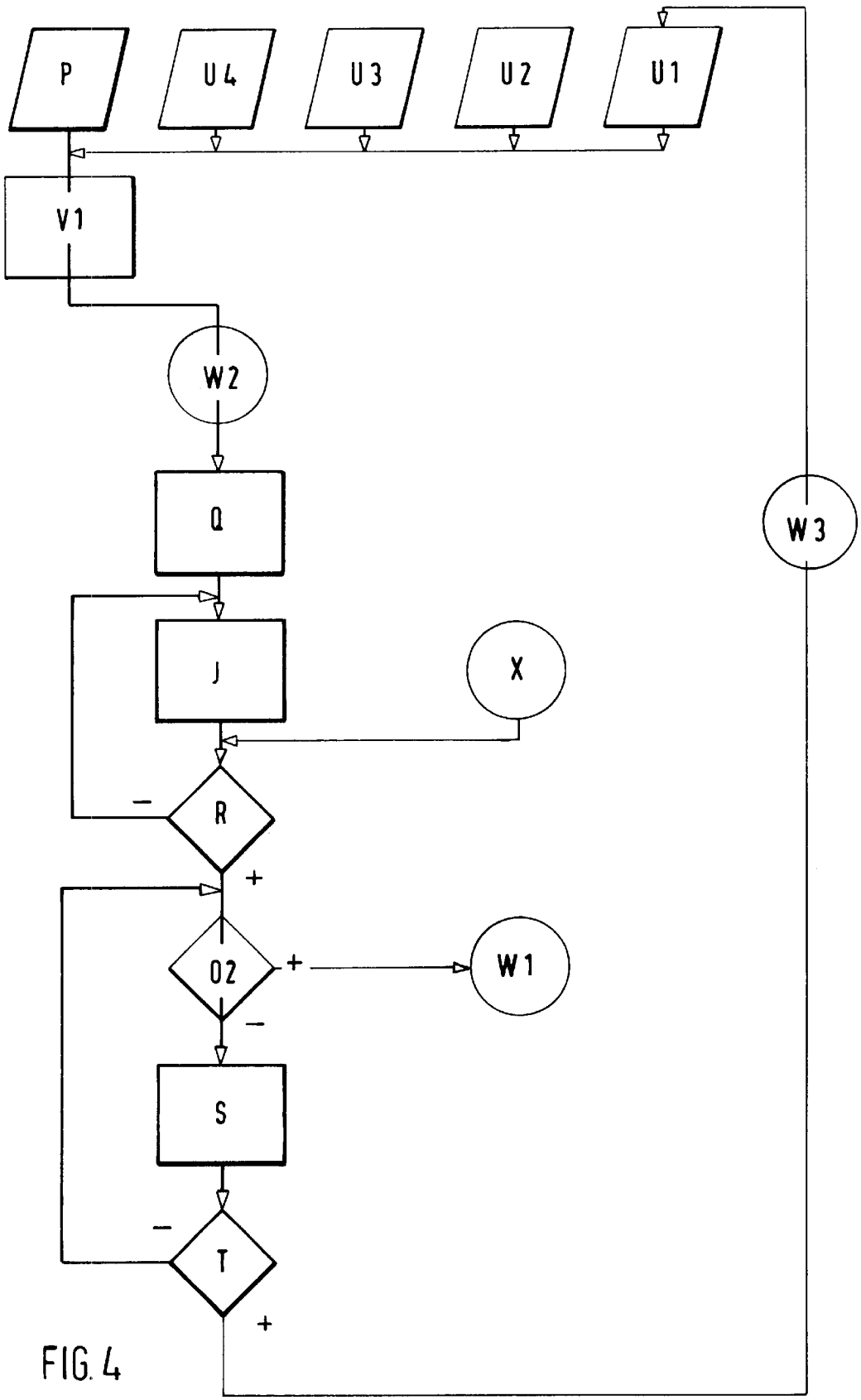

Previously, without statement, the presupposition was assumed, that the individual control devices 30A, 30B, 30C, . . . , by means of their reply signal output (step L) would confirm the receipt of the read-request which was output in step J. This is not necessarily the case. FIG. 4 shows a flow diagram for the optimization of the start of an open-end spinning machine.

In order to make a start thread available, first the specification values must be input into the control devices 30A, 30B, 30C, . . . and/or into their overriding central control apparatus 4, 4*a*, . . . , this being step P. In this matter, the central control apparatus 4, 4*a*, . . . possesses an input field with an input apparatus 44 and/or the individual control device 30A, . . . and an input field with an input apparatus 301. For instance, these inputs would be in regard to the already input specification values, or concerning the length of the desired start-thread, or the thickness of the same in relation to the normal thread thickness, etc. The input values in the control devices 30A, 30B, 30C—which previously could have been empirically determined in a laboratory and then input (i.e. stored ) in the form of a program into the individual control device 30A, 30B, 30C, . . . —because of transform-rules, are transformed into setting values (step Q). These setting values are, for instance, time periods for the switching on of the drive for the feed roll 100 and/or the value for the determination of a curve for the acceleration, which the feed roll is to experience during its increase in speed to full operational rotational speed. In an analogous manner, alternatively, by means of complete, or partial turn-around of the circumferentially circulating fiber-air-stream in the disintegration element 11 in the housing 111, the quantity of single fibers 20, which are sent to the spinning element 12, can be controlled.

The spinning point, i.e. a thread monitor, is cyclically interrogated (step J) as to whether a disturbance of the spinning operation, for instance, in the form of a thread break has occurred.

If the query as to a disturbance is denied, (see minus sign at step R), then the question is repeated (step J), until, at some time, this query has to receives a "yes" reply (see plus sign at step R). The disturbance is, for instance, transmitted to a robot installed for such service work. Then, a start operation or attach procedure is carried out.

In the case of the said start operation or attach procedure, the end of the thread 21 is brought to the spinning element 12, until it comes in contact with the single fibers 20 which are accumulating there. By means of this contact making of the thread 21 with the single fibers 20, these are incorporated into the end of the thread 21, which then can be once again drawn out of the spinning element 12.

After the carrying out of the attaching of the thread, a check is made as to whether the said attach procedure has actually been successfully executed and the thread break corrected (step T). If this is not the case, (minus sign at step T), then the thread start procedure is repeated (step S).

Many times, the said thread start operation procedure does not succeed, so that at the work-station in question, 6, 60, . . . or 7, 70, . . . , it becomes necessary for the operating person to intervene. So that the service apparatus 19, (FIG. 1) does not carry out useless endeavors to attempt a start operation, a specified number of trials is determined. After reaching this number the start operation attempts at this particular work-station 6, 60, . . . or 7, 70, . . . are broken off. At each start operation attempt, the count-value in a counter (not shown) is increased by "1". Before each start operation, in accord with FIG. 4, an interrogation is made as to whether or not the pre-set number has been reached. (step $O_2$). If the result is "no" (minus sign at step $O_2$), then a start operation will be run (step S). If, on the other hand, the set number of failed attempts has been reached (plus sign at step $O_2$), then that function is repressed (see transition $W_1$ as well as steps $N_1$, $N_2$, $N_3$, $N_4$, . . . in FIG. 3).

The success or failure of the start operation, that is, the connection position of the returned thread 21 with the newly spun fibers 21, depends upon various factors, which will be explained in the following. In the most simple case, the deviation of the start operation from the desired result is determined by the operating personnel without any auxiliary equipment, who thereupon inputs changed set value (step P).

A more exact examination of the start operation, in some cases, can be carried out in a laboratory, whereby, also in this case, the so determined values for the input of new set values can be made.

The most secure and precise examination of the results of the start is made by means of measurements. Because of this, in FIG. 4, an advantageous variant is presented, in accord with which, in the case that the incorporation procedure has succeeded (see plus sign at step T), the bulk run of the start thread is checked by measurement (step $U_1$). This is done by the thread monitor 18, which has been correspondingly so designed and was already mentioned in FIG. 6). In this case, thread monitor 18 is connected by means of line 323 with the individual control devices 30A, . . . .

Based on the measurement results of the thread monitor 18, it becomes evident if and how far the prepared start thread operation deviates from the desired result. This gives opportunity so that, the previously input set values can be correspondingly altered (step $V_1$). The conversion of these corrected set points into input values can be carried out, as described before, by means of the step Q, onto which join the further steps J. R. S and T, and in some cases with the interposing of the work step $O_2$, or J, R, J, R, J, R, . . . , The correction made on the basis of measurement of the start procedure acts, therefore, immediately in the case of the next start-procedure (step S), wherein, measuring will take place in this and in each ensuing initiation of the prepared start thread operation and serves for the optimizing of the following start operation procedures.

The invention is not limited to the foregoing, described embodiments, but can, within the framework of the present invention, be altered in a multitude of ways, especially by the exchange of single or a plurality of features with equivalents, or yet by means of other combinations thereof. Experience has shown, that the eventual results of a start depend not only on the fiber feed, that is, on the operation of the fiber feed, but also on other factors which can essentially influence the performance of such an operation. Factors of this kind include, for instance, the humidity of the air, the RPM of the spinning element—or, in some cases, the electro or magnetic field in the rotating air vortex or even the thickness of the fed-in fiber band 2.

In order to determine these values there is provided, in accord with the embodiment shown in FIG. 6, additional measurement and/or supervisory apparatuses. Accordingly, for instance, by means of a line 320, a measurement apparatus 180 is connected to the control device 30 for the determination of the air humidity, The values for air humidity determined by this measurement apparatus 180 is the basis for alateration, i.e. the correction, of the specified set values (step $V_1$).

A further item among the previously named factors is the thickness of the fiber band 2 in the feed system. If the band thickness varies, for instance because of the insertion of a new fiber band 2, then the band guidance 16 (FIG. 6) changes its pivoted position to accommodate the new thickness. The pivot position, thus becomes a measurement for the thickness of the band.

Since the band guide 16 is in control-related communication with the control devices 30A, 30B, 30C, . . . through the line 321, these pivoting movements, i.e. the pivot positions of the band guide 16 (step $U_3$) can be utilized for the control of the start, since the determined measurement results from the correction of the specified preset values (step $V_1$) are included therein.

As mentioned above, a role is played by the speed of rotation, i.e. the RPM of another spinning element 12 (or air vortex, or the electro-magnetic field of a spinning element 12 of this kind). On this account, in accord with FIG. 6, a measurement apparatus 123 is provided, which, in a non-contact manner, on its own determines the RPM (step $U_4$). The measurement results of this determination are transmitted through line 322 to the individual control devices 30A, 30B, 30C, . . . . Also, in these determinations, the correction of the set point (step $V_1$) have been taken into consideration.

The determined measurement values essentially give evidence, which factors are to be considered for thread-start, but not in what manner this is to be done. Above, in connection with the brief explanation of the spinning start, it was made clear, that the result of a start procedure did not depend on the operation of the feed apparatus alone.

Essential for the success or failure of an thread-start procedure, is the start and the speed of the thread return, as the start is done, for instance, in the spinning element 12 through the thread return 17, both of which can be designed in the conventional manner. For instance, the thread return apparatus 17 possesses a restraining element 170, which, for instance, is constructed as a spindle. The free thread 21, which is intended for the start, is first held back in winding up on the restraining spindle 170 and only released at the desired moment for the spinning start, by means of change in axial position of the spindle of the thread 21, wherein the end of the wound spindle is presented. In this operation, this restraining element 170 can be moved, by means of an appropriate drive 171, out of the indicated position in a direction of normal thread path, in order to draw the thread 21 out of this said path to make it free for its return to the spinning element 12. When this is done, the speed of pivoting plays an important role for the quickness of thread return and thus also for the start of the spinning.

In addition, important for the effectiveness of the start operation, is the time lapse from the beginning of the contact acceptance of the returned thread 21 at the spinning element 12 to the start of the withdrawal of the spun thread 21.

First, the withdrawal of the spun-on thread is done by the spool 23, which, up to this point, is held at a distance from the spool roll 140 by the lifting device 143, and therefore finds itself in a raised condition from the spool roll 140. The drive roll 151 finds itself in contact with the spool 23, but at first, is not being driven. In a coinciding time moment with the return of the thread 21 to the spinning element 12, the drive roll 151 is energized by the drive 154, and then, accelerated in such a way, that the bulk run of the start-thread corresponds to the specified run conditions. The drive roll 151 drives, accordingly, the spool 23, which thus withdraws the thread 21 from the spinning element 12 and winds it up. If the spool 23 has finally reached the full operational RPM, at which the circumferential speed of the drive roll 151, and correspondingly, also that of the spool 23, agrees with the circumferential speed of the spool roll 140, then the spool 23, by means of release by the lifting device 143 lowers itself onto the driven spool roll 140 and is now driven by this said roll. The drive roll 151, the pivot arm of which is released by the pivot drive 153, follows this pivot movement, so that the drive of the spool 23 is not interrupted at any moment. After the drive of the spool 23 has been taken over by the spool roll 140, by the action of the pivot drive 153 on the pivot arm 150, the drive roll 151 is lifted from the spool 23. At that moment, the drive 154 comes to stillstand.

As soon as the withdrawal of the thread 21 has achieved the set speed from the winding up of the said thread 21 on the spool 23, the thread withdrawal apparatus 13 can now take over further thread 21 withdrawal, while the spool 23 simply winds up the thread 21 brought to it by the thread withdrawal apparatus 13. The thread 21, which is in process of withdrawal, proceeds in a conventional manner to contact circumferentially the driven withdrawal roll 130. The take-over of the thread withdrawal by the thread withdrawal apparatus 13 is brought about by the lowering of the previously lifted pressure roll 133 onto the driven withdrawal roll 130. This action was instigated by the release of the free end 137 of the lever 134 which is loaded by the tension spring 136, or the like by the lifting element 138.

The determination of the point in time for the surrender of the thread by the thread return apparatus 17 and for the resumption of the thread withdrawal with the aid of the auxiliary apparatus 15, as well as the determination of the acceleration curve during the spinning start procedure (step S) are carried out in accord with the preset specified values (step P), input into the control equipment by the operating person, possibly already in their corrected mode (step $V_1$).

Since the centrifugal force brought about by the RPM of the spinning element 12 also has an effect on the consolidation of the individual fibers 20 into the end of the returned thread 21, then, this rotational speed and the start up characteristics of the previously inactive spinning element are brought into agreement with speed curves of the above mentioned components. Since this agreement is known, a presentation of the elements required for this is dispensed with. There is only depicted the feed back of a measurement apparatus 123 assigned to the spinning element 12 and its connecting line 322 (FIG. 6).

As already mentioned, the single, individual control devices 30A, 30B, 30C . . . are cyclically interrogated in accord with a specified rhythm input by the clock 41 (FIG. 1) from the central control apparatus 4, 4*a*, . . . (see step J—FIGS. 3, 4).

To this, the single work stations 6, 60, . . . or 7, 70, . . . react by the sending of a reply (step L). A check is carried out, as to whether or not a reply has been registered (step M—FIG. 3). In case the reply was "yes" (see plus sign at step M), then an examination is made as to whether a thread break has occurred (transition to the start operation cycle—step X—as well as subsequent step R—see FIG. 4). If no reply has been made, (see minus sign at step R in FIG. 4) then, within the established rhythm of the clock 41, once again read-requests are sent to the corresponding control devices 30A, 30B, 30C, . . . .

Figure 5:
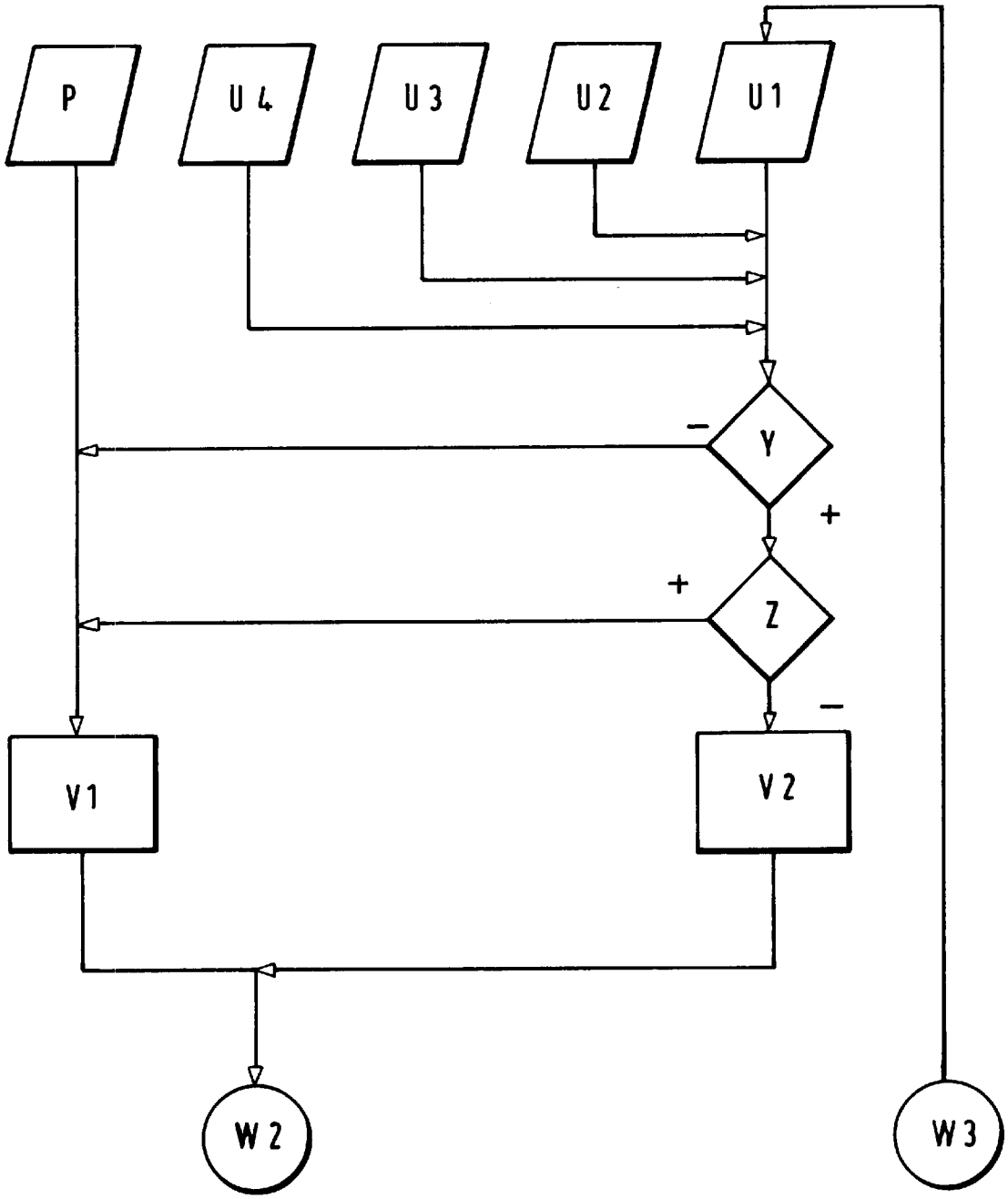

In accord with the foregoing embodiment which has been described, the specifications for pre-input are corrected, if the start operation has not yet achieved the expected result (step $V_1$ in FIG. 5). If it becomes apparent, however, that the adjustment in general is yet to be corrected, then it is possible to alter (step $V_2$ in FIG. 5), in addition to, or instead of, the input values, also the specified rules, upon which the adjustment values depend.

In this way, it can be determined, as to whether the specified input values (step $V_1$) or the rules (step $V_2$) are to be altered, or whether the said specified. values (step $V_1$) as well as the rules (step $V_2$) should be changed. Based on this situation, in accord with FIG. 5, following the measurement of the start operation results (step $U_1$) the interrogation is made as to whether the rules should be changed (step Y). If the placed query is answered by "no", (see minus sign at step Y), then a switch-over is made to step $V_1$, that is, to a correction with the previously given values in accord with step P. If, on the contrary, the reply was "yes", (see plus sign at step Y) then subsequently the question will be asked as to whether the specified, pre-input values should be corrected in addition to the rules (step Z). If the reply is "yes" (plus sign at step Z) then a corresponding signal for the correction of the pre-input specified values (step $V_1$) as well as a signal for the correction of the rules (step $V_2$) is released. If the question, on the contrary, is given a "no" reply, (minus sign at step Z), then simply a correction of the rules (step V2) is sent, but not a correction of the specified values (step $V_1$).

When the specified, pre-input values, in accord with step $V_1$ and/or the rules of step $V_2$ have been corrected, then the procedure runs in a continuous manner as already described in connection with FIG. 4. This is made clear in FIGS. 4, 5 by the designation $W_2$. If a start procedure has been successfully completed, then the start-thread is again measured (step $U_1$) and the required corrections are carried out anew in accord with FIG. 5. This transition from the procedural steps of FIG. 4, to the procedural steps of FIG. 5 is made clear by the designation $W_3$ in the FIGS. 4, 5.

For the computation of the corrections, in accord with steps $V_1$ and/or $V_2$, it is advantageous, not to lay down rigid computational methods but to keep these computational modalities flexible. On this basis, the employment of Fuzzy Logic in the central control apparatus 4, 4*a*, . . . and/or in the individual control devices 30A, 30B, . . . proves itself to be useful. Even better results may be achieved, when the individual control devices 30A, 30B, 30C, . . . and/or the central control apparatus 4, 4*a*, . . . become "teachable" in this way and the input values optimize themselves on their own.

There has been described in the foregoing, that in the carrying out of a start operation procedure, the individual components brought into the start are to be set into operation in a prescribed sequence and are next to be brought up to their normal operational speed. Particularly critical is also a phase of a short duration voltage variance, or even a total drop-out. In order, in such a case, not to be obliged to start the machine all over again, there are certain preparations which can be made, by means of which such short drop-out times can be bridged over. In accord with FIG. 6, for this purpose, an auxiliary electrical power source 9, i.e., a generator, is connected to the withdrawal roll 130 by means of an overdrive 90. This said generator is continually driven by the withdrawal roll 130, or at least, in the case of the said power failure, is in a drive connection with the withdrawal roll 130. Since this, in the depicted example is shown as a shaft, which extends itself over the entire length of the textile machine and thus also over section 8, 80, . . . it possesses a relatively great inertial mass which can be used up for the drive of the auxiliary power source 9.

The auxiliary power source is, by means of a line 91 in connection with the main control apparatus 5; which delivers the required voltage, i.e. regulates the said voltage, necessary for the controlled shut down of the machine.

A voltage monitor 51 is in electrical communication over the line 510 with the main control apparatus 5, which supervises the voltage delivered from the principal source of power, namely, the utility network. If the voltage drops below a set threshold, then this deficiency is registered by the main control apparatus 5 and the controlled shutdown of the machine is initiated. As this happens, the speed relationships between the components which influence the quality of the thread remains as it was previously, i.e. unchanged. If, within the time frame (FIG. 6), during which period the speed relationships required for the maintenance of unchanged spinning conditions can be guaranteed, by means of the said voltage monitor 51, the renewed availability of a normal voltage is displayed, then, the main control apparatus 5, orders control through the central control apparatus 4, 4*a*, . . . in such a manner, that the individual control devices 30A, . . . and possibly 30*a*, . . . , are once again brought up to their operational speeds with the same speed relationships which existed during the normal spinning process.

The said time frame set by the timer 50, is that period which has been previously, empirically set in and monitored by timer 50 and has been transferred to the main control 5 as a specified time period. If, contrary to the above, the required voltage for faultless spinning has not been reestablished within that said time period, then any further controlled shut down of the machine is of no avail, because a collapse of the speed relationships which can no more be upheld, lead to producing a useless thread. Based on this, after the elapse of the specified time period, the auxiliary current source is shut down. This can be effected by the mechanical uncoupling of the withdrawal roll 130 or by an electrical disconnect of the line 90, or yet in another appropriate way such as the interruption of the data exchange between the various components and the individual control devices 30A, . . . . In case it is desired, provision can be made, that instead of, or in addition to, the shut down of the auxiliary current source 9, the components can be brought to a sudden halt by the activation of braking means which possibly may be provided.

This step would assure that following the reestablishment of the normal voltage conditions, the least amount of time would be lost for start. This is because it would not be required to wait out the running down of the components, before the spinning start could be carried out again in the manner already described. For this purpose, then, the components, on which the renewed spinning will take place, will be again switched on by the central control apparatus 4, 4*a* . . . . This is done by the origination of a start-up signal to the individual control device 30A, . . . , whereby, possibly, up to the beginning of the spinning start procedure, the same can be awaited at the concerned work-station 6,.

It should be appreciated by those skilled in the art that various modifications and variations can be made to the apparatus and procedure according to the invention as described herein without departing from the scope and spirit of the invention as set forth in the appended claims and their equivalents.

What is claimed is:

1. A procedure for controlling individual components of a work station in a textile machine having a plurality of the workstations disposed in proximity to each other, the workstation components having individual control devices, said process comprising:

connecting the components at the workstations to a bus system, wherein the bus system is in turn connected to a central control apparatus;

setting identifying addresses for the components to a default value;

recognizing with the central control apparatus that the components have been installed;

initializing a recognition phase wherein the components are interrogated by the central control apparatus and the default address is converted to a component specific address such that for a given section of the textile machine, the same components have different specific addresses;

controlling operations relating to the components with the central control apparatus that communicates with selected components through their respective control device in accordance with their respective component specific address; and wherein for the exchange of several components wherein at least one such component is already provided with a component specific address, connecting the exchange components to the bus system and initializing an initialization phase and resetting the component specific addresses of the exchange components to their default addresses prior to said recognition phase.

2. The procedure as in claim 1, wherein after said initialization phase wherein the default addresses are reset, isolating all of the components connected to the central control apparatus from the central control apparatus and subsequently reconnecting the components to the central control apparatus in sequence and initializing said recognition phase as each component is reconnected to the central control apparatus.

3. A procedure for controlling individual components of a work station in a textile machine having a plurality of the workstations disposed in proximity to each other, the workstation components having individual control devices, said process comprising:

connecting the components at the workstations to a bus system, wherein the bus system is in turn connected to a central control apparatus;

setting identifying addresses for the components to a default value;

recognizing with the central control apparatus that the components have been installed;

initializing a recognition phase wherein the components are interrogated by the central control apparatus and the default address is converted to a component specific address such that for a given section of the textile machine, the same components have different specific addresses;

controlling operations relating to the components with the central control apparatus that communicates with selected components through their respective control device in accordance with their respective component specific address; and establishing an initialization phase prior to connection of the components to the bus system such that any component subsequently connected to the bus system is immediately assigned a default address.

4. A procedure for controlling individual components of a work station in a textile machine having a plurality of the workstations disposed in proximity to each other, the workstation components having individual control devices, said process comprising:

connecting the components at the workstations to a bus system, wherein the bus system is in turn connected to a central control apparatus;

setting identifying addresses for the components to a default value;

recognizing with the central control apparatus that the components have been installed;

initializing a recognition phase wherein the components are interrogated by the central control apparatus and the default address is converted to a component specific address such that for a given section of the textile machine, the same components have different specific addresses;

controlling operations relating to the components with the central control apparatus that communicates with selected components through their respective control device in accordance with their respective component specific address; and generating with said central control apparatus a signal designating the work station at which the next component is to be connected to the bus system.

5. A procedure for controlling individual components of a work station in a textile machine having a plurality of the workstations disposed in proximity to each other, the workstation components having individual control devices, said process comprising:

connecting the components at the workstations to a bus system, wherein the bus system is in turn connected to a central control apparatus;

setting identifying addresses for the components to a default value;

recognizing with the central control apparatus that the components have been installed;

initializing a recognition phase wherein the components are interrogated by the central control apparatus and the default address is converted to a component specific address such that for a given section of the textile machine, the same components have different specific addresses;

controlling operations relating to the components with the central control apparatus that communicates with selected components through their respective control device in accordance with their respective component specific address; and upon lack of an answer from an individual control device after a specified period of time to a read-request from the central control apparatus, initiating at least one of the following: the read-request is sent again to the individual control device; the individual control device stops its associated component; the component-specific address of the corresponding component is converted to a default address; and a fault alarm is initiated.

6. The procedure as in claim 5, wherein for replacement or exchange of a component with another component, placing the central control apparatus in an exchange mode and assigning the new component control device a default address and subsequently assigning a component specific address.

7. The procedure as in claim 5, wherein for subsequent replacement or exchange of a component with another component, assigning the component specific address for the component being replaced to the replacement component.

8. The procedure as in claim 5, comprising determining the component specific addresses as a function of relative location of the components.

9. The procedure as in claim 5, comprising conducting the recognition phase sequentially on the components, and the recognition phase for a given component is not initialized until the recognition phase for the preceding component is complete.

10. The procedure as in claim 5, wherein the central control apparatus has a number of initialization addresses that it cycles through, and further comprising conducting an initialization phase wherein in conjunction with the recognition phase, the default addresses are cyclically converted to the initialization addresses and the initialization addresses are converted to the component specific addresses.

11. The procedure as in claim 10, comprising initiating the initialization phase and recognition phase by connection of the components to the bus system.

12. The procedure as in claim 11, comprising sending a control voltage or signal to the component by the central control apparatus to initiate the initialization and recognition phases.

13. The procedure as in claim 10, comprising registering a component lacking a default address or a component specific address as absent in the central control apparatus.

14. The procedure as in claim 10, comprising physically indicating a successful conversion of a default address into a component specific address for a recognized component.

15. The procedure as in claim 14, comprising activating and intermittently driving the component upon successful conversion of a default address to a component specific address.

16. A procedure for controlling individual components of a work station in a textile machine having a plurality of the workstations disposed in proximity to each other, the workstation components having individual control devices, said process comprising:

connecting the components at the workstations to a bus system, wherein the bus system is in turn connected to a central control apparatus;

setting identifying addresses for the components to a default value;

recognizing with the central control apparatus that the components have been installed;

initializing a recognition phase wherein the components are interrogated by the central control apparatus and the default address is converted to a component specific address such that for a given section of the textile machine, the same components have different specific addresses;

controlling operations relating to the components with the central control apparatus that communicates with selected components through their respective control device in accordance with their respective component specific address; and wherein the textile machine is an open-end spinning machine and the work station components are fiber feeding components for feeding fibers to spinning elements at the work stations, the fiber feeding components carrying out a thread start operation in accordance with a previously determined first input set values, said procedure further comprising monitoring thread characteristics of the spun thread made in accordance with the first input set values, comparing the monitored thread characteristics to desired values for the characteristics, and correcting any combination of the input set values to adjust for the desired values so that the next subsequent thread start operation is conducted in accordance with adjusted input set values.

17. The procedure as in claim 16, wherein the monitored thread characteristic is bulk run.

18. The procedure as in claim 17, further comprising measuring any combination of the following parameters influencing bulk run: relative humidity, rotational speed of the spinning element, and thickness of fiber band being delivered to the feeding components.

19. The procedure as in claim 16, further comprising determining the first set of input set values and the modified input set values by fuzzy logic.

20. A procedure for controlling individual components of a work station in a textile machine having a plurality of the workstations disposed in proximity to each other, the workstation components having individual control devices, said process comprising:

connecting the components at the workstations to a bus system, wherein the bus system is in turn connected to a central control apparatus;

setting identifying addresses for the components to a default value;

recognizing with the central control apparatus that the components have been installed;

initializing a recognition phase wherein the components are interrogated by the central control apparatus and the default address is converted to a component specific address such that for a given section of the textile machine, the same components have different specific addresses;

controlling operations relating to the components with the central control apparatus that communicates with selected components through their respective control device in accordance with their respective component specific address; and further comprising activating an auxiliary current source for supplying the work station components upon failure of operational line voltage, and shutting down the work station components in a controlled manner as they are supplied by the auxiliary current source, and controllably returning the work station components to operational speed upon return of the line voltage.

21. The procedure as in claim 20, comprising shutting down the work station components without control or braking upon expiration of a pre-determined time delay after loss of the line voltage.

* * * * *